US007331388B2

(12) United States Patent
Vilela et al.

(10) Patent No.: US 7,331,388 B2
(45) **Date of Patent: *Feb. 19, 2008**

(54) HORIZONTAL SINGLE TRIP SYSTEM WITH ROTATING JETTING TOOL

(75) Inventors: Alvaro Jose Vilela, Rio de Janeiro (BR); David Joseph Walker, Latayetto, LA (US); Wade Rebardi, Carencro, LA (US); Marvin Bryce Traweek, Houston, TX (US); Floyd Bishop, Humble, TX (US)

(73) Assignee: BJ Services Company, Houston, TX (US)

( * ) Notice: Subject to any disclaimer, the term of this patent is extended or adjusted under 35 U.S.C. 154(b) by 163 days.

This patent is subject to a terminal disclaimer.

(21) Appl. No.: 11/348,275

(22) Filed: Feb. 6, 2006

(65) Prior Publication Data

US 2006/0231253 A1 Oct. 19, 2006

Related U.S. Application Data

(63) Continuation-in-part of application No. 10/095,182, filed on Mar. 11, 2002, now Pat. No. 7,017,664.

(60) Provisional application No. 60/670,723, filed on Apr. 13, 2005, provisional application No. 60/314,689, filed on Aug. 24, 2001.

(51) Int. Cl.
*E21B 43/04* (2006.01)

(52) U.S. Cl. ..... 166/278; 166/51

(58) Field of Classification Search ..... 166/51, 166/278, 332.4

See application file for complete search history.

(56) References Cited

U.S. PATENT DOCUMENTS 1,379,815 A 5/1921 Hall ..... 166/146
2,657,753 A 11/1953 Carpenter ..... 166/302

(Continued)

FOREIGN PATENT DOCUMENTS

GB 2 393 466 3/2004

(Continued)

OTHER PUBLICATIONS

Stanley, F.O., "Matrix Acidizing Horizontal Gravel-Packed Wells for Fines Damage Removal," *Society of Petroleum Engineers*, SPE 65519:1-10 (Nov. 6-8, 2000).

(Continued)

*Primary Examiner*—William P Neuder
(74) *Attorney, Agent, or Firm*—Howrey LLP

(57) ABSTRACT

A method for completing a well in a single trip is described, which includes inserting a completion tool assembly into the wellbore. The completion tool assembly includes a gravel packing assembly having a central channel substantially therethrough and a service tool assembly slidably positioned within the central channel. The service tool includes a pressure pulsating rotating jetting tool, connectable to a washpipe via a differential valve. By selectively dropping a plurality of plugging devices into the completion tool, multiple operations may be selectively performed in the wellbore in a single trip. In this way, the gravel packing and stimulating operations may be performed by a single completion tool assembly in a single trip into the wellbore, thus reducing the cost and time for performing the gravel packing and stimulating operations.

25 Claims, 28 Drawing Sheets

U.S. PATENT DOCUMENTS

| | | | | |
|---|---|---|---|---|
| 2,677,428 | A | 5/1954 | CLark | 166/26 |
| 3,741,300 | A | 6/1973 | Wolf et al. | 166/184 |
| 4,037,661 | A | 7/1977 | Ford | 166/311 |
| 4,040,486 | A | 8/1977 | Kirkland, Jr. | 166/311 |
| 4,046,199 | A | 9/1977 | Tafoya | 166/303 |
| 4,452,313 | A | 6/1984 | McMahan | 166/373 |
| 4,482,016 | A | 11/1984 | Richardson | 166/300 |
| 4,498,536 | A | 2/1985 | Ross et al. | 166/250 |
| 4,694,901 | A | 9/1987 | Skinner | 166/222 |
| 4,765,410 | A | 8/1988 | Rogers et al. | 166/303 |
| 4,771,829 | A | 9/1988 | Sparlin | 166/233 |
| 4,919,204 | A | 4/1990 | Baker et al. | 166/223 |
| 5,069,285 | A | 12/1991 | Nuckols | 166/311 |
| 5,533,571 | A | 7/1996 | Surjaatmadja et al. | 166/222 |
| 5,603,378 | A | 2/1997 | Alford | 166/222 |
| 5,783,526 | A | 7/1998 | Dobson, Jr. et al. | 507/261 |
| 5,836,394 | A | 11/1998 | Blank | 166/312 |
| 5,909,769 | A | 6/1999 | Duhon et al. | 166/115 |
| 5,944,123 | A | 8/1999 | Johnson | 175/73 |
| 6,032,741 | A | 3/2000 | Johnson | 166/312 |
| 6,062,311 | A | 5/2000 | Johnson et al. | 166/312 |
| 6,148,915 | A | 11/2000 | Mullen et al. | 166/278 |
| 6,216,785 | B1 | 4/2001 | Achee, Jr. et al. | 166/278 |
| 6,227,298 | B1 | 5/2001 | Patel | 252/62.52 |
| 6,336,502 | B1 | 1/2002 | Surjaatmadja et al. | 166/104 |
| 6,352,119 | B1 | 3/2002 | Patel | 166/386 |
| 6,397,864 | B1 | 6/2002 | Johnson | 134/167 |
| 6,568,474 | B2 | 5/2003 | George et al. | 166/278 |
| 6,571,875 | B2 | 6/2003 | Bissonnette et al. | 166/278 |
| 6,575,246 | B2 | 6/2003 | Bixenman et al. | 166/278 |
| 6,832,655 | B2 | 12/2004 | Ravensbergen et al. | 166/311 |
| 7,017,664 | B2 | 3/2006 | Walker et al. | 166/278 |
| 2002/0139532 | A1 | 10/2002 | Todd et al. | 166/300 |
| 2003/0037925 | A1 | 2/2003 | Walker et al. | 166/276 |
| 2005/0061503 | A1* | 3/2005 | Misselbrook et al. | 166/278 |

FOREIGN PATENT DOCUMENTS

| | | |
|---|---|---|
| WO | WO0104457 | 1/2001 |

OTHER PUBLICATIONS

Stanley, F.O., "An Economic, Field-Proven Method for Removing Fines Damage from Gavel Packs," *Society of Petroleum Engineers*, SPE 58790 (Feb. 23-24, 2002).

Arangath et al., "A Cost-Effective Approach To Improve Performance of Horizontal Wells Drilled in High Permeability Formations," *Society of Petroleum Engineers*, SPE 73786 (Feb. 20-21, 2002).

Fowler, S.H., "A Reeled-Tubing Downhole Jet Cleaning System," *Society of Petroleum Engineers,*, SPE 21676:411-416 (Apr. 7-9, 1999).

Connell, Michael L. et al., "Coiled Tubing-Deployed Jetting Tool Enhances Cleaning and Jet Cutting," *Society of Petroleum Engineers*, SPE 60705 (Apr. 5-6, 2000).

Cobb, Charles C., "New Coiled Tubing Jet Cleaning System Reduces Costs," *Petroleum Engineer Int'l* (Oct. 1985).

Brochure entitled Hydra-Blast® Pro$^{SM}$ Service, by Halliburton Energy Services, Inc. (Dec. 1999).

Brochure entitled "Roto-Jet™ Precision Rotary Jetting Technology," by Nowsco.

"Roto-Jet® Rotary Jetting Tool", BJ Services Company, Apr. 11, 2002.

Vilela, Alvaro, et al., "Novel Single Trip Horizontal Gravel Pack and Selective Stimulation System Improves Injectivity in Deepwater Wells," *Society of Petroleum Engineers*, SPE 84260 (© 2003).

Vilela, Alvaro, et al., "Differential Pressure Valve Incorprated With the Single-Trip Horizontal Gravel Pac and Selective Stimulation System Improves Sand Control for Extended Reach Wells," *Society of Petroleum Engineers*, SPE 86513 (© 2004).

Vilela, Alvaro, et al., "Deepwater Four Zones Selective Washpipeless Frac-Pack Completion Inside a Bad Cemented Liner: A Case History," *Society of Petroleum Engineers*, SPE 90510 (© 2004).

Combined Search and Examination Report dated Aug. 7, 2006.

Product Sales bulletin: Roto-Jet (RTM) Rotary jetting Tool [BJ Services] available at bjservices.com/website/ps.nsf/35de05b28692e7a686256a48004aacdb/33cdf24d34410d7c86256b990067a1ab/$FILE/Roto-Jet%20Rotary%20Jetting/20Toolrev.pdf.

OSCA, The Bottom-Up Gravel Pack System, TX10-6A & 6B, 1999, 2 pages, United States.

OSCA, Wash Down Type CompSet Non-Gravel Pack System, TX10-30, 1999, 1 page, United States.

* cited by examiner

HORIZONTAL SINGLE TRIP SYSTEM WITH ROTATING JETTING TOOL

CROSS-REFERENCE TO RELATED APPLICATIONS

This application is a non-provisional application claiming priority of U.S. provisional application 60/670,723, filed Apr. 13, 2005, by Alvaro Jose Vilela, which is hereby incorporated by reference in its entirety. This application also claims priority to and is a continuation-in-part application of co-pending U.S. patent application Ser. No. 10/095,182 entitled "Single Trip Horizontal Gravel Pack and Stimulation System" by David Joseph Walker, Wade Ribardi, Marvin Bryce Traweek and Floyd Bishop filed Mar. 11, 2002 now U.S. Pat. No. 7,017,664, which claims priority to provisional application No. 60/314,689 filed Aug. 24, 2001, each of which is incorporated by reference herein and is commonly-owned by the Assignee of the present application, BJ Services Company.

BACKGROUND OF THE INVENTION

1. Field of the Invention

This invention relates in general to the field of gravel packing and stimulation systems for mineral production wells, and more particularly, to an improved method and system for performing gravel packing and stimulation operations. The present invention also relates to the completion of wellbores in the field of oil and gas recovery. More particularly, this invention relates to an improved apparatus adapted to provide a method of performing multiple downhole operations, such as gravel packing and stimulating/servicing in a single trip. The present invention also relates to a method of providing stimulation or treatment fluid through a gravel pack or gravel pack screens such that filter cake can be effectively removed from the wellbore. More particularly, the invention relates to a method for providing mechanical energy of high pressure rotating jets to force the stimulation or treatment fluid through the gravel pack screens, thus creating a mechanical diversion to remove the filter cake, without damaging the gravel pack.

2. Description of the Related Art

In an effort to extract natural resources such as oil and gas, it is becoming increasingly common to drill a vertical well, and to subsequently branch off that well and continue to drill horizontally for hundreds or even thousands of feet. The common method for drilling horizontally will be described more fully below, but generally includes the steps of forming a fluid impermeable filter cake surrounding the natural well bore while drilling at the production zone, removing drilling fluid from the downhole service tools (washdown), performing gravel packing operations, and then removing the downhole service tools from the well bore. A stimulation tool is then run back into the well, and the well stimulated with the appropriate chemicals to remove the filter cake so that production may begin. The above-described method requires two "trips" down into the well bore with different tools to accomplish gravel packing and well stimulation. Each trip into the well can take as much as a day, with the cost of a rig running anywhere from $50,000.00 to $250,000.00 per day. Accordingly, achieving both gravel packing and stimulation in a single trip can be substantially beneficial. Further, each additional trip into the well also increases the risk of fluid loss from the formation. Fluid loss in some cases may substantially reduce the ability of the well to effectively produce hydrocarbons. Therefore, there is a need for a system and method that simply and reliably performs gravel packing and stimulation operations in a single trip into the well.

The drilling of horizontal wells is becoming increasingly common in an effort to extract natural resources such as oil and gas. In horizontal wells it is common practice not to form a casing in the wellbore along the portion of the horizontal wellbore through which oil or gas is to be extracted. Instead, during drilling operations a filter cake is deposited on an inner surface of the wellbore. This filter cake is typically a calcium carbonate or some other saturated salt solution that is relatively fluid impermeable, and therefore, impermeable to the oil or gas in the surrounding formation. The filter cake is formed during drilling by pumping a filter cake slurry having particles suspended therein into the wellbore. The particles are deposited on the wellbore surface, eventually forming a barrier that is sufficiently impermeable to liquid. Systems and methods for depositing such a filter cake are well known in the art. I With the filter cake in place, the drilling equipment is removed from the well, and other tools are inserted into the well to pack the well with gravel. Once gravel packing is complete, the filter cake must be stimulated with the proper chemical solution to dissolve the filter cake to maximize production flow into the well. Further, some companies only stimulate injectors; such that filter cake can be produced through the sand and screen but cannot be effectively pumped into the wellbore. Typical prior art systems and methods require removal of gravel packing tools and subsequent insertion of stimulation tools.

The steps of placing the filter cake, gravel packing, and stimulation are often utilized with horizontal wells. A common method for drilling horizontally generally includes forming a fluid-impermeable filter cake surrounding the natural well bore while drilling at the production zone, removing drilling fluid from the downhole service tools (washdown), performing gravel packing operations, and then removing the downhole service tools from the well bore. In a second operation, a stimulation tool is then run back into the well, and the well stimulated with the appropriate chemicals to remove the filter cake so that production may begin.

The above-described method requires two trips down into the wellbore with different tools to accomplish gravel packing and well stimulation operations. Each trip into the well takes time, thus increasing the costs of performing the operations. Each trip also increases the risk of fluid loss into the formation. Thus, it is desirable to perform both the gravel packing operation and the stimulation operation in a single trip. According to the present disclosure, however, a single tool assembly can be lowered into the well to perform both gravel packing and stimulation in one trip.

Some methods for performing the gravel packing operation and stimulation in a single trip, such as U.S. application Ser. No. 10/095,182 to Walker, incorporated by reference herein as described above, utilize seal subassemblies in conjunction with slick joints in some embodiments. The slick joints may be sized to mate with the plurality of seal subs, such that layers downhole may be isolated. Such methods may be utilized to stimulate horizontal wellbores in a layer-by-layer, screen-by-screen fashion. As is known in the art, the seal subs are spaced such that the seal subs cooperate with the slick joints to selectively seal a given stratification layer downhole. By pulling upwardly on the workstring, a different stratification layer is isolated. Such systems utilize given slick joints for cooperation with a give wellbore, such that the slick joint cooperates with a plurality of seal subs to isolate given zones.

It is desirable to provide a single trip system, which may be utilized without utilizing the slick joint/seal sub combination, and thus eliminating the sizing of the slick joints/seal subs. Such a system would advantageously be able to stimulate a plurality of production screens as the tool is pulled out of hole, in a continuous—as opposed to performing a layer-by-layer stimulation—operation. Further, such methods perform the stimulation operation sequentially through layers lying along production screens. It is also desirable to utilize a pressure pulsating rotating jetting tool to improve the stimulation operation downhole.

Embodiments of the present invention are directed at overcoming, or reducing and minimizing the effects of, any shortcomings associated with the prior art.

SUMMARY OF THE INVENTION

In accordance with the present disclosure, there is a system which enable gravel packing and stimulating a horizontal well on a single trip into the well. Where a horizontal well is packed with a filter cake during a drilling operation, the present invention is used to gravel pack proximate to the production zone and stimulate the production zone by removing the filter cake, all in a single trip.

According to one aspect of the invention, there is provided a method for completing a well comprising the steps of: inserting a completion tool assembly into the well, the completion tool assembly having a gravel packing assembly and a service tool assembly slidably positioned substantially within an interior cavity in the gravel packing assembly; removably coupling the service tool assembly and the gravel packing assembly; inserting a first plugging device into an interior channel within the service tool assembly to substantially block fluid from flowing through the interior channel past the first plugging device; diverting the fluid blocked by the first plugging device through a first fluid flow path to an exterior of the completion tool assembly; gravel packing the well with the completion tool assembly; inserting a second plugging device into the interior channel of the service tool assembly to substantially block fluid from flowing through the interior channel past the second plugging device; diverting the fluid blocked by the second plugging device through a second flow path that reenters the interior channel at a location distal of the first and second plugging devices; and stimulating the well with the well completion assembly.

In some embodiments, the invention relates to a completion tool assembly that includes a gravel pack assembly having a longitudinal channel (e.g. a passageway or bore) substantially through the length of the assembly. The completion tool assembly further includes a stimulation or service tool assembly movably positioned within the channel. In some embodiments, the completion tool assembly includes a pressure pulsating rotation jetting tool adapted to provide selective stimulation of the wellbore.

In some aspects, a plurality of plugging devices are selectively dropped from surface, thereby selectively providing fluid communication through given passageways in the completion tool assembly, such that the completion tool assembly may perform multiple completion operations (e.g. gravel packing and stimulating) in a single trip, in some embodiments. Utilizing the completion tool and system described hereinafter allows the gravel packing tool and stimulation/service tool to be run and utilized in a single trip.

The completion tool assembly of present disclosure may be utilized primarily in horizontal gravel pack operations. The completion tool assembly of some embodiments allows (1) a gravel packing assembly to be installed and the gravel pack to be pumped, and (2) the well to be stimulated. These steps may be performed in a single trip. The benefits of the completion tool assembly include valuable rig-time savings and, efficient mechanical diversion of the stimulation fluid by the use of a rotating high jet velocity jetting tool. Hydrostatic pressure may be maintained on the formation during all treatment phases, thus preventing any underbalance that could lift the filter cake off the formation and cause undesirable fluid losses.

In operation of some embodiments, the completion tool assembly having a longitudinal channel substantially along the length, is run into the wellbore. A first ball may be dropped to selectively block the internal channel, which selectively alters fluid flow in a manner described hereinafter to set the packer. After setting and testing the packer, a slurry is poured downhole, with the returns passing into the internal channel of the tool on the lower end to return to surface. After gravel packing, a second plugging device ball is dropped into the internal channel thus opening a bypass area and converting the gravel pack tool to a stimulation tool. The system then provides the ability to perform a filter cake cleanup and stimulation by treating the horizontal interval of the well.

The rotating high jet velocity jetting tool is intended to be run at the bottom of the wash pipe and uses the mechanical energy of the high pressure pulsating jets to force the treatment fluid/stimulation fluid through the production screens, thus creating a mechanical diversion and providing a reliable solution that does not damage the gravel pack. A differential valve is run in conjunction with the rotating jetting tool in order to provide the ability of circulating the gravel packing at a very low pressure. During the gravel pack treatment placement, the differential valve opens and becomes the return flow path around the bottom of the tailpipe thus reducing backpressure that would have been caused by the jetting tool, and thus preventing filter cake damage (or even the fracturing of the formation) without slowing the pump rate.

In some embodiments, the method includes creating a pulsating jet a subterranean wellbore to perform the stimulation operation and to drive the stimulation fluid into the formation to dissolve the filter cake.

Figure 1:
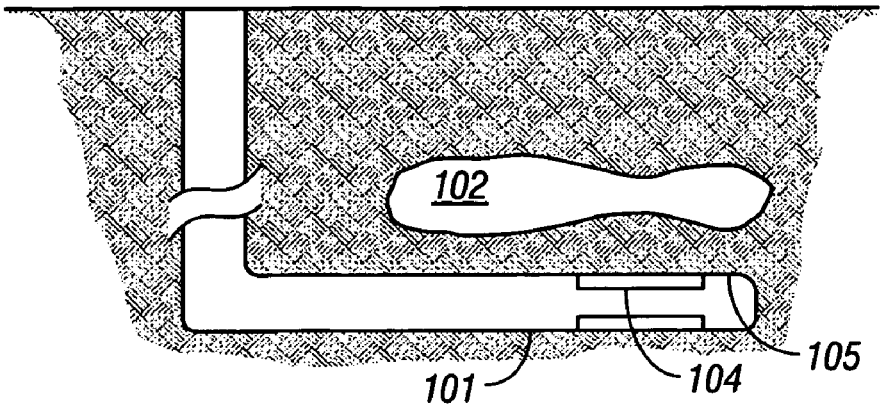
FIG. 1 illustrates a typical horizontal well having a filter cake covering a portion of the wellbore wall; (Prior Art).
Figure 2:
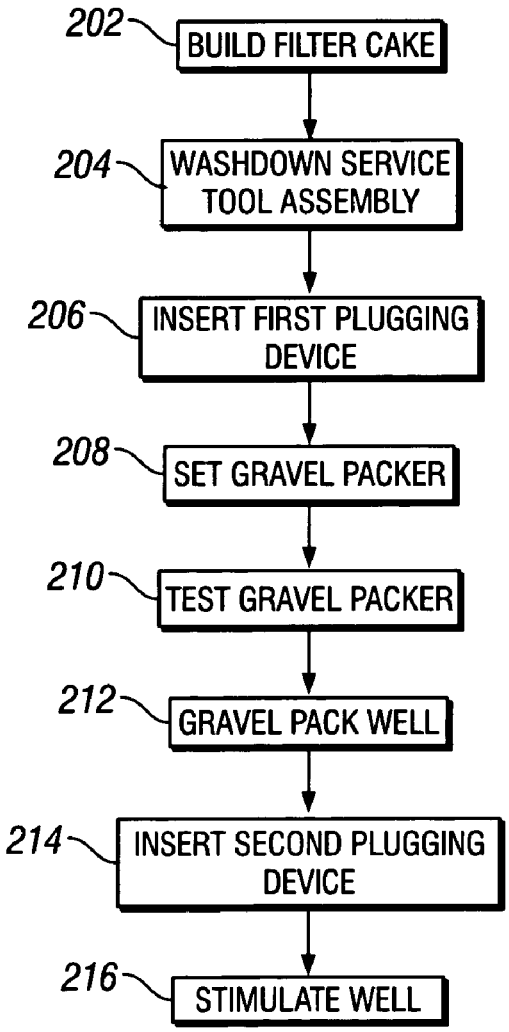
FIG. 2 is a flow chart illustrating steps for completing a well according to the present disclosure.

While the invention is susceptible to various modifications and alternatives forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation and in the completion of wellbore, especially horizontal wellbores. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated hat such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures. Similar reference designators will be used to refer to corresponding elements in the different figures of the drawings. Although various embodiments have been shown and described, the invention is not so limited and will be understood to include all such modifications and variations as would be apparent to one skilled in the art.

Preferred embodiments of the present invention are illustrated in the Figures, like numeral being used to refer to like and corresponding parts of the various drawings.

Referring now to FIG. 1, in horizontal wells 101 it is common practice not to form a casing in the well bore 100 along the portion of the horizontal wellbore through which oil or gas 102 is to be extracted. Instead, during drilling operations a "filter cake" 104 is deposited on an inner surface 105 of the wellbore. This filter cake is typically a calcium carbonate or some other saturated salt solution that is relatively fluid impermeable, and therefore, impermeable to the oil or gas in the surrounding formation. The filter cake is formed during drilling by pumping a slurry having particles suspended therein into the wellbore. The particles are deposited on the wellbore surface, eventually forming a barrier that is sufficiently impermeable to liquid. Systems and methods for depositing such a filter cake are well known in the art.

With the filter cake in place, the drilling equipment is removed from the well, and other tools are inserted into the well to pack the well with gravel. Once gravel packing is complete, the filter cake must be "stimulated" with the proper chemical solution to dissolve it to maximize production flow into the well. As indicated above, prior art systems and methods require removal of gravel packing tools and subsequent insertion of stimulation tools. According to the present disclosure, however, a single tool assembly can be lowered into the well to perform both gravel packing and stimulation in one trip.

A system and method for gravel packing and stimulating a well bore will now be described in greater detail with reference to FIGS. 1-8. According to one embodiment of the present disclosure, a completion tool assembly 301 including a gravel packing assembly 300 and a service tool assembly 330 is run into the well 101. The gravel packing assembly has an interior cavity 345 extending substantially along its entire length, and a substantial portion of the length of the service tool assembly is slidably positioned within the interior cavity of the gravel packing assembly. The service tool assembly can be retracted relative to the gravel packing assembly as is illustrated in FIGS. 3-8 and as will be described further below Although not explicitly shown in FIGS. 3-8, it is to be understood that a filter cake has already been deposited along the appropriate portion of the wellbore 101 (step 202 of FIG. 2).

The gravel packing assembly includes at a distal end 343 a production screen 306. The production screen may be a single screen, or preferably multiple production screen sections 306*a* interconnected by a suitable sealed joint 380, such as an inverted seal subassembly. When production begins, the production screen filters out sand and other elements of the formation from the oil or gas. The service tool assembly 330 includes a service string 332 coupled to a cross-over tool 334. A proximal end 336 of the service tool assembly includes a setting tool 382 that removably couples the service tool assembly to the gravel packer 320 of the gravel packing assembly at the proximal end 346 of the completion tool assembly. The proximal end of the service tool assembly is also coupled to a pipe string (not shown) that extends to the surface of the well for manipulating the service tool assembly.

Figure 3:
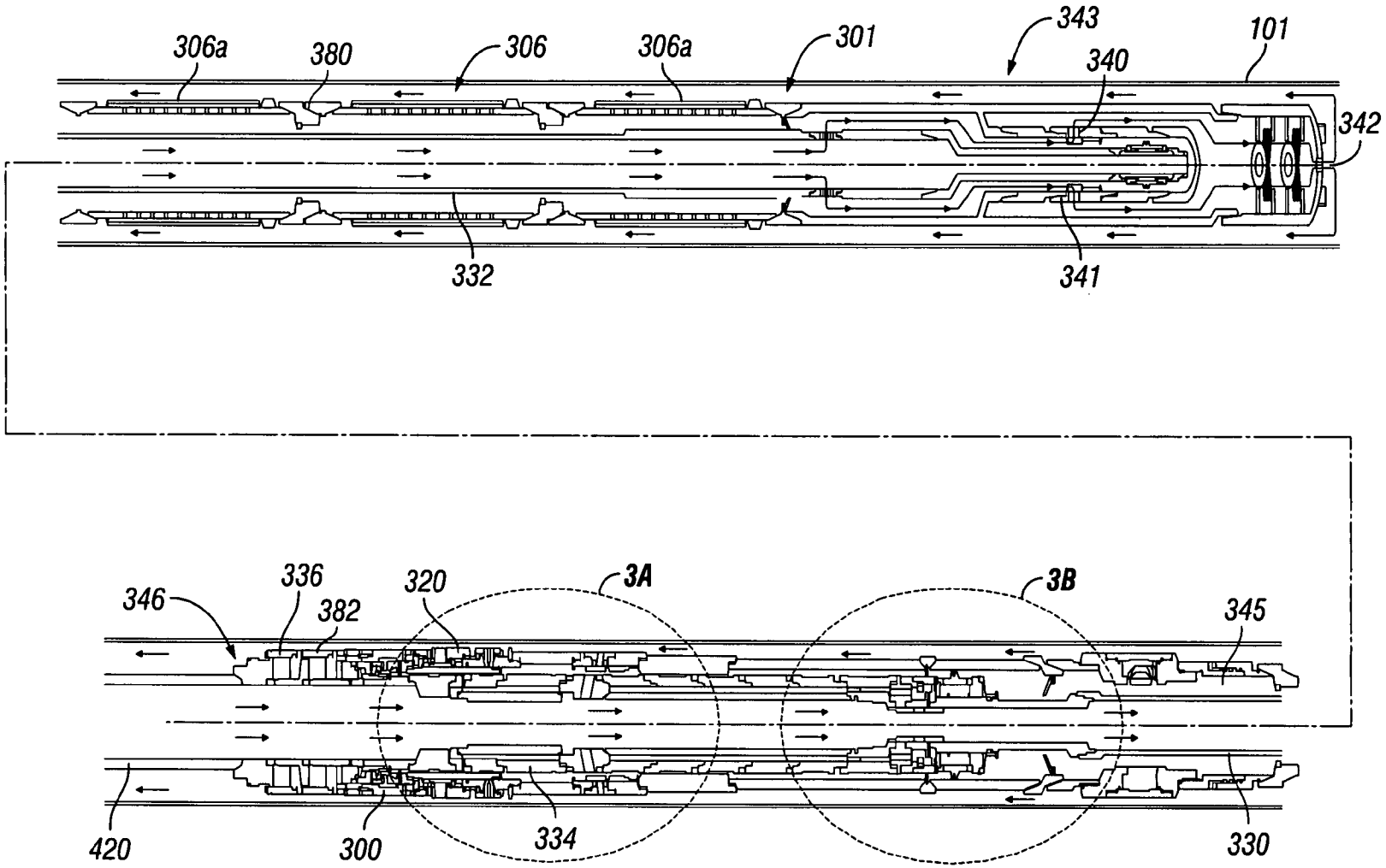
FIG. 3 illustrates a well completion tool assembly according to the present disclosure during washdown.
Figure 3A:
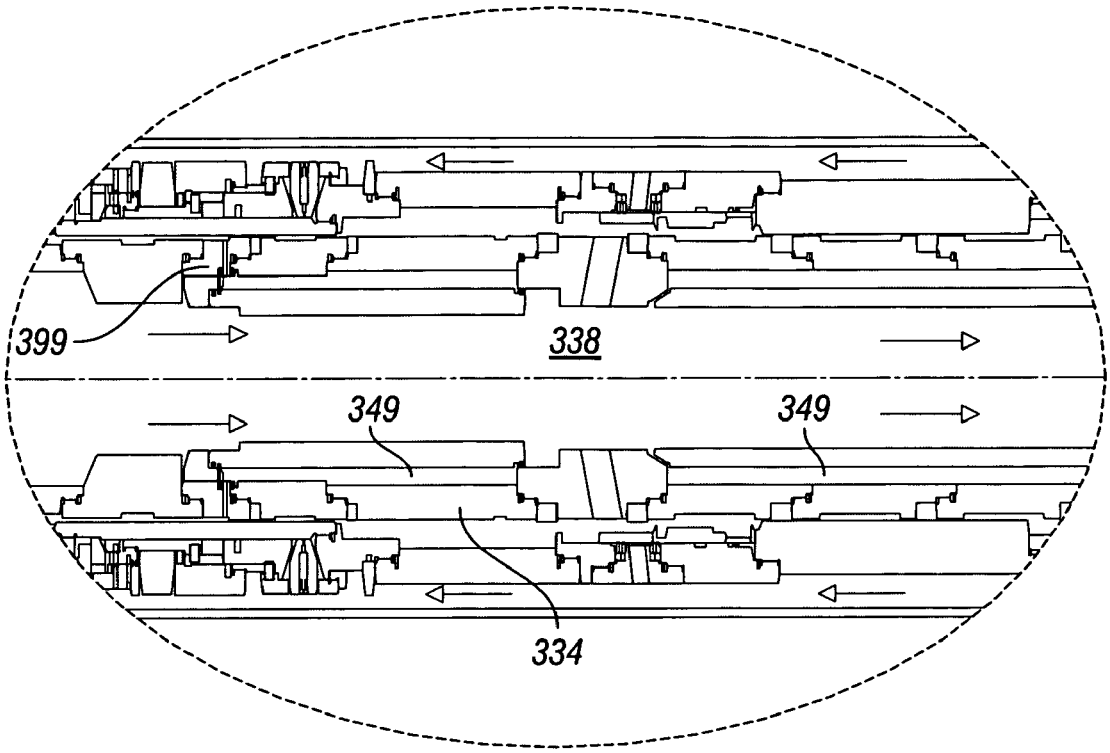
Figure 3B:
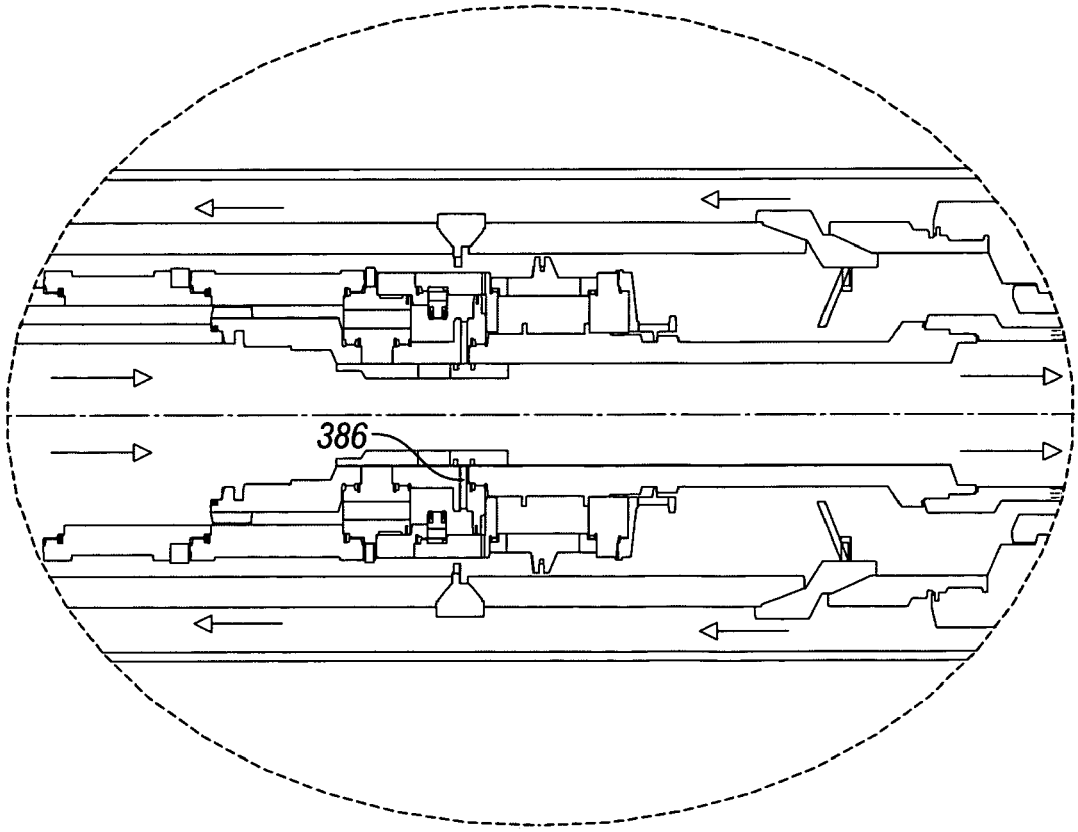

Cross-over tool 334 is of a type also well known in the art. Cross-over tool 334 includes at least one cross-over tool aperture 350 (see FIG. 6, not shown in FIG. 3) providing a fluid flow path between the interior channel 338 and an exterior of the cross-over tool. It also includes a separate internal conduits 349 that form a fluid flow path between an annular bypass port 386 that opens into the interior channel at a location distal of the cross-over tool apertures, and an exterior port 399 that opens to the exterior of the cross-over tool at a location proximal of the cross-over tool apertures. With the gravel packing assembly and service tool assembly in position within the wellbore as shown in FIG. 3, wash-down operations (FIG. 2, step 204) are performed to remove any remaining drilling fluid or debris from the service tool assembly by pumping clean fluid therethrough. The fluid flow path during washdown is illustrated by the arrows in FIG. 3.

As shown, fluid flows in a substantially unobstructed path through an interior channel 338 in the service tool assembly. The fluid flows out into the well area through a distal aperture(s) 340 at the distal end 341 of the service tool assembly and a distal aperture(s) 342 at the distal end 343 of the gravel packing assembly and well completion tool, and back in the annular space between the completion tool assembly and the wellbore that, before setting of the gravel packer, is present along the entire length of the completion tool assembly. In this manner, the service string assembly and the outer annular area between the gravel pack and screen assembly and the casing/formation are flushed clean of any remaining drilling fluid or debris.

After washdown is complete, gravel packing operations begin, and the completion tool assembly described herein can simply and readily perform both operations. As indicated above, during washdown the interior channel 338 of the service tool assembly is substantially unobstructed. According to the present system and method, a first plugging device 322 is inserted into the interior channel 338 (step 206) to form an obstruction and divert the fluid path to enable setting of the gravel packer. The first plugging device may be made of any suitable material and of any suitable configuration such that it will substantially prevent fluid from flowing through the interior channel past the first plugging device. According to one embodiment, the first plugging device is a spherical steel ball. It is inserted into place by dropping it into the annulus of the tool string at the surface of the well, and will travel into the proper position within the service tool assembly by means of gravity and fluid flow. A primary ball seat 398 may also be positioned within the interior channel of the service tool assembly to help retain the first plugging device in the proper position.

Figure 4:
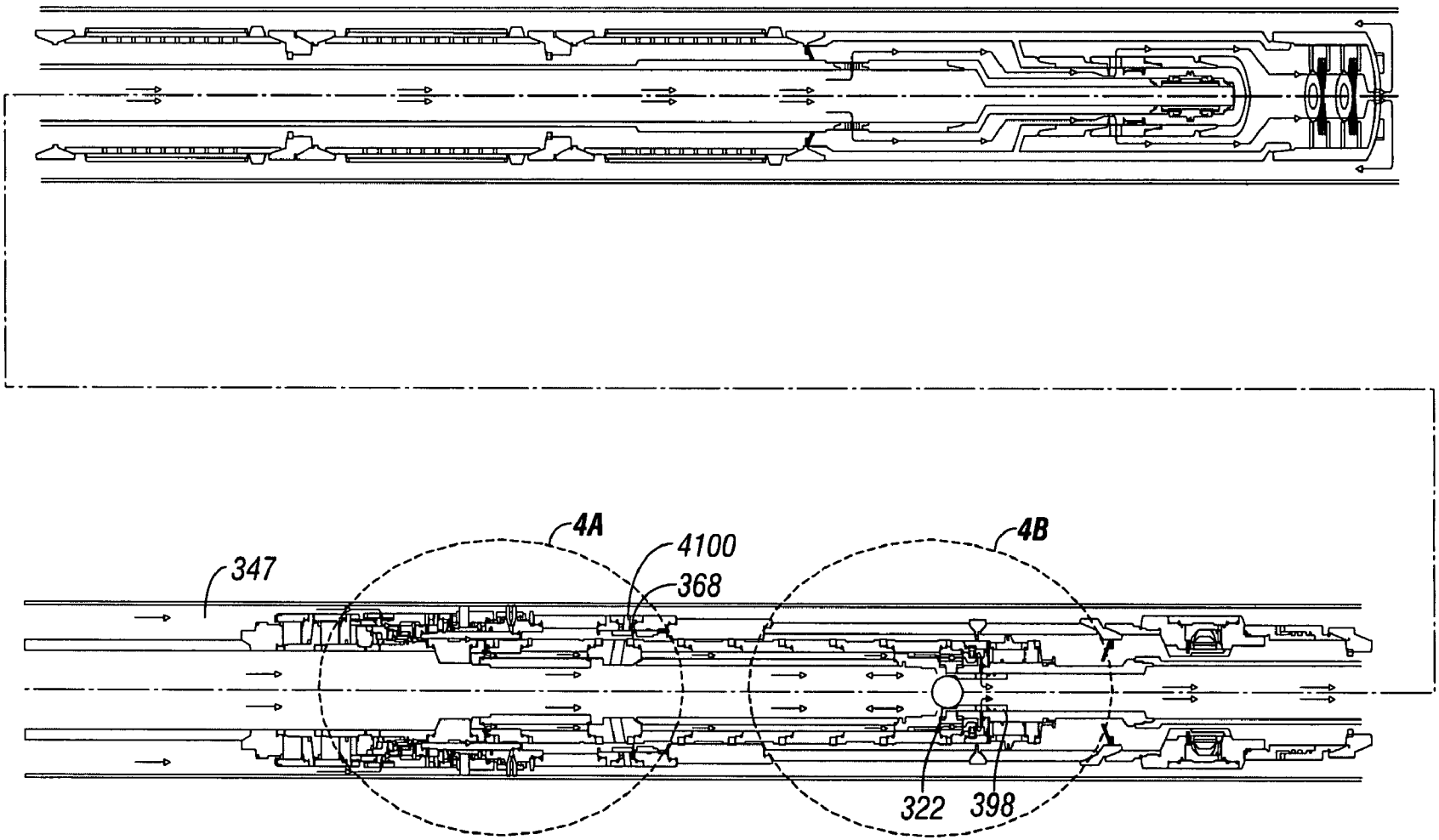
FIG. 4 illustrates a well completion tool assembly according to the present disclosure during setting of the gravel packer.
Figure 4A:
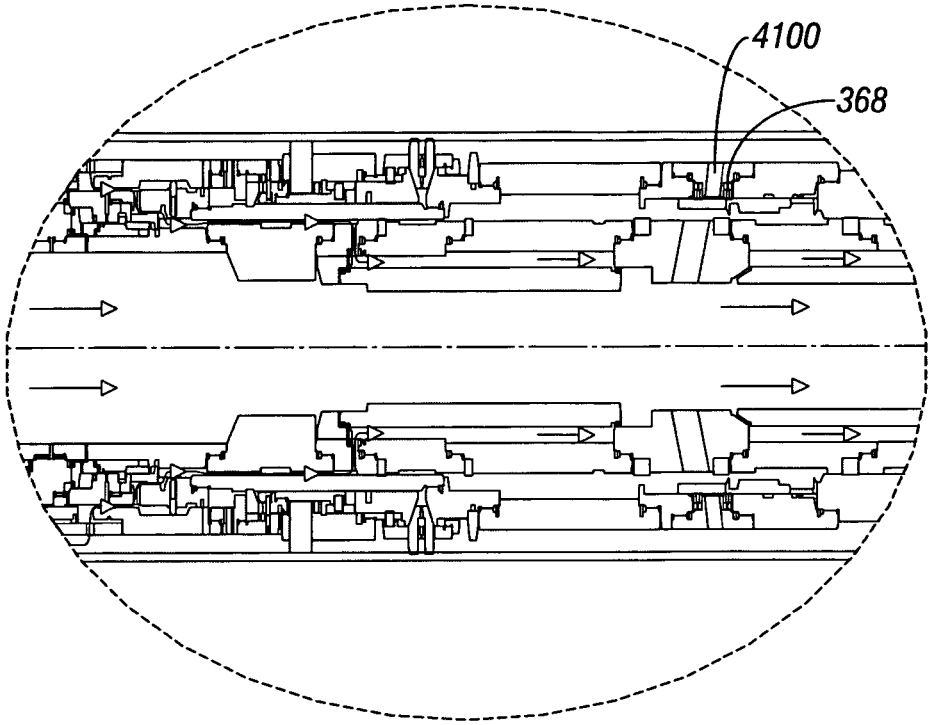
Figure 4B:
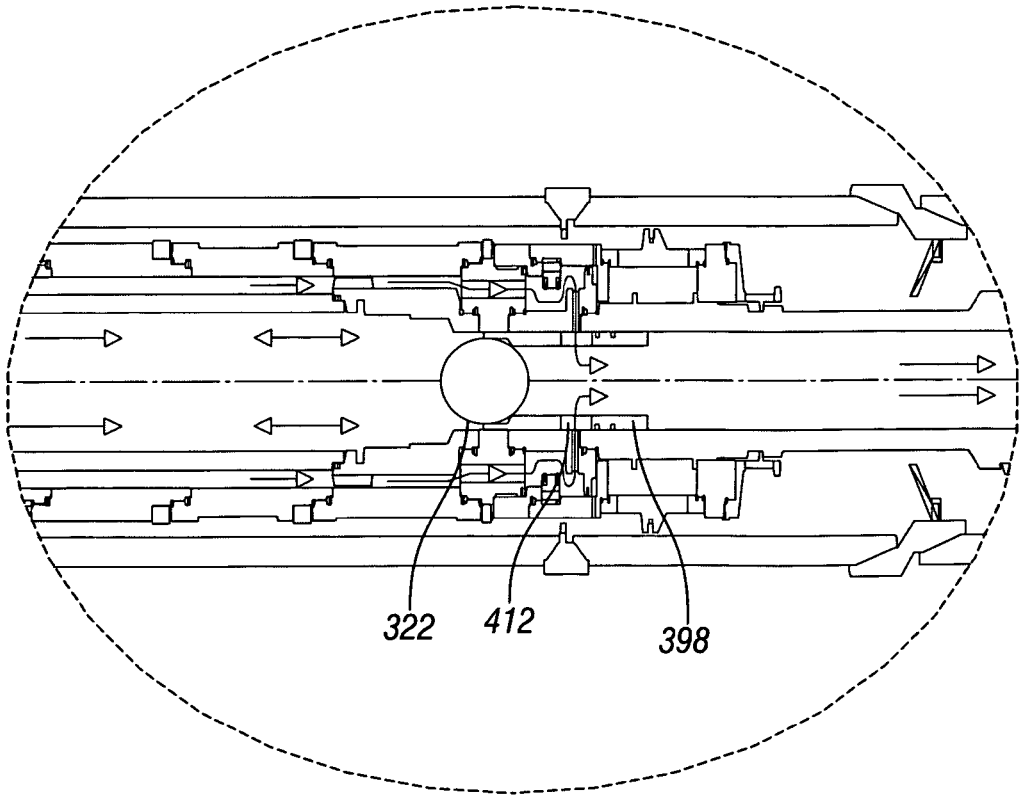

As shown in FIG. 4, the gravel packing assembly has at least one gravel packing aperture therein that, when the service tool assembly is removably coupled to the gravel packing assembly, is aligned with the cross-over tool aperture such that fluid may flow from the interior channel and through both apertures when unobstructed. A temporary closing sleeve 368, however, controls fluid flow through the gravel packing assembly apertures, and is in the closed position during setting of the gravel packer as shown in FIG. 4 (step 208). Thus, during setting, the first plugging device 322 obstructs fluid flow through the interior channel 338, and because the temporary closing sleeve is also closed, fluid pressure within the interior channel 338 of the service tool assembly builds up in the vicinity of the gravel packer sufficiently to force the gravel packer outwards against the wellbore, thereby setting the gravel packer in place against the wellbore. These techniques are well known in the art, as are standard cross-over tools.

The completion tool assembly of the present invention, however, is also able to maintain annular pressure on the well formation during setting of the gravel packer. The well completion tool assembly includes an annular bypass closing mechanism for selectively opening and closing the annular bypass port. According to one embodiment, this annular bypass closing mechanism includes a device positioned within the interior channel that is slidable relative to the interior channel between open and closed positions. The device is configured so that when in the closed position, it obstructs the annular bypass port, and when slid into the open position it is configured so as not to obstruct the annular bypass port. According to one embodiment, the device is also the primary ball seat. Seating of the first plugging device within the primary ball seat causes the primary ball seat to slide sufficiently so that an opening therein becomes substantially aligned with the annular bypass port 386 so as not to obstruct it. Thus, fluid may freely flow from a first annular space 347 proximal of the gravel packer through the internal cross-over tool channels and into the interior channel at a location distal of the first plugging device. Thus, annular pressure is maintained on the formation to help maintain its integrity prior to gravel pack operations.

Figure 5:
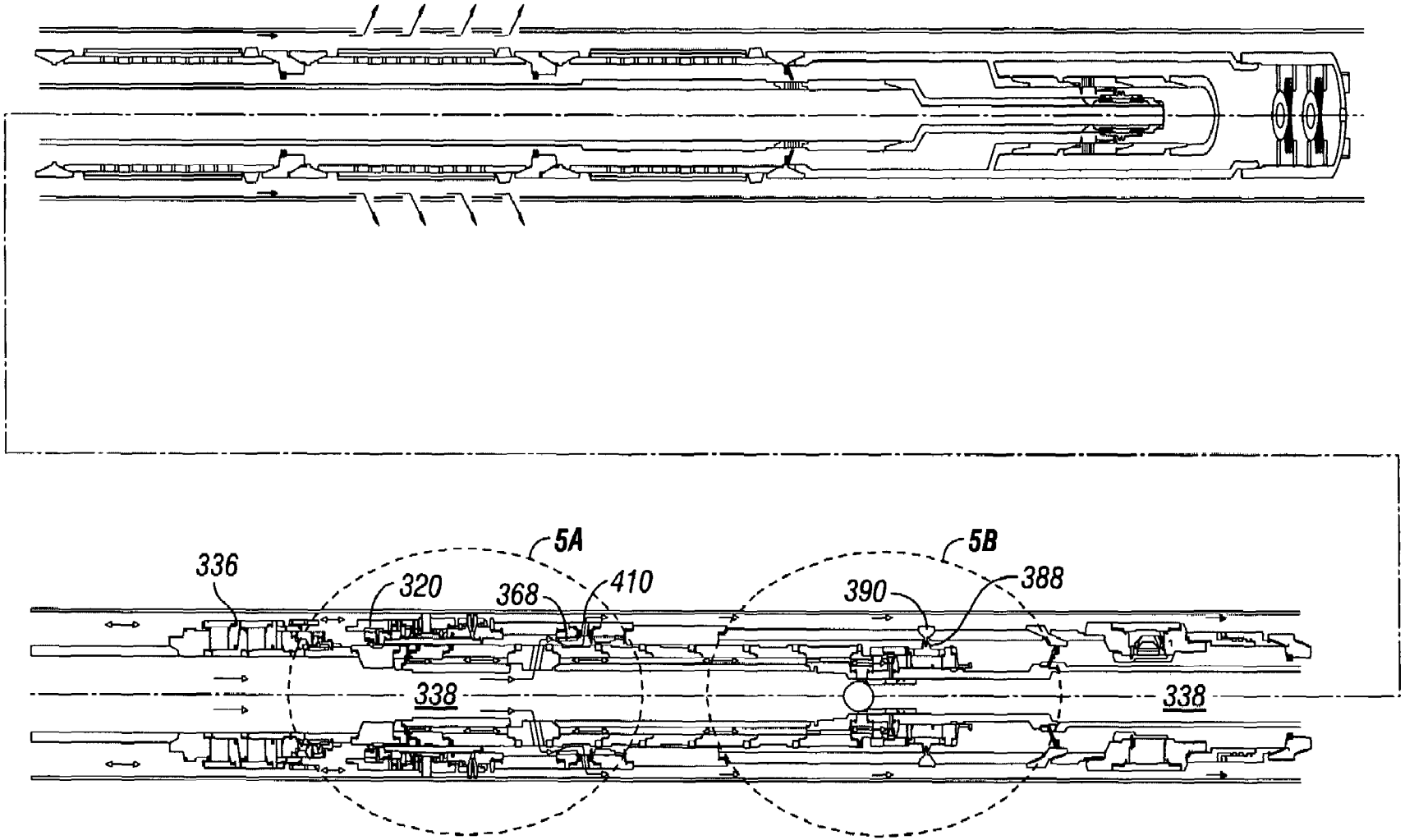
FIG. 5 illustrates a well completion tool assembly according to the present disclosure during testing of the gravel packer.
Figure 5A:
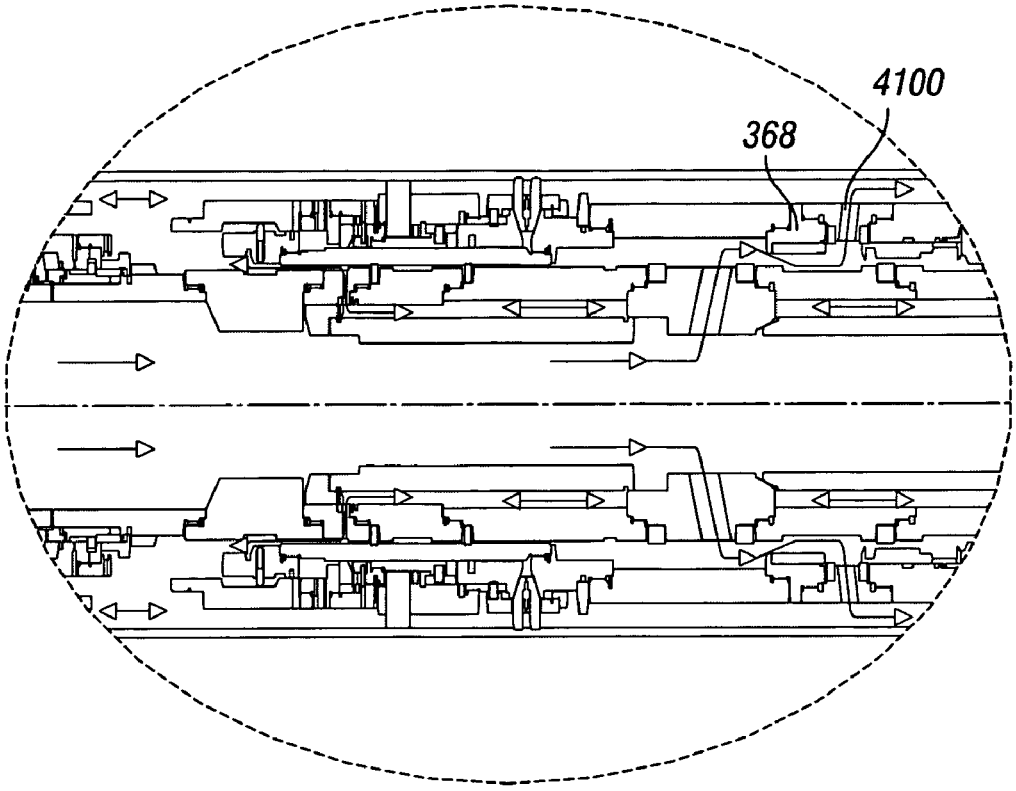
Figure 5B:
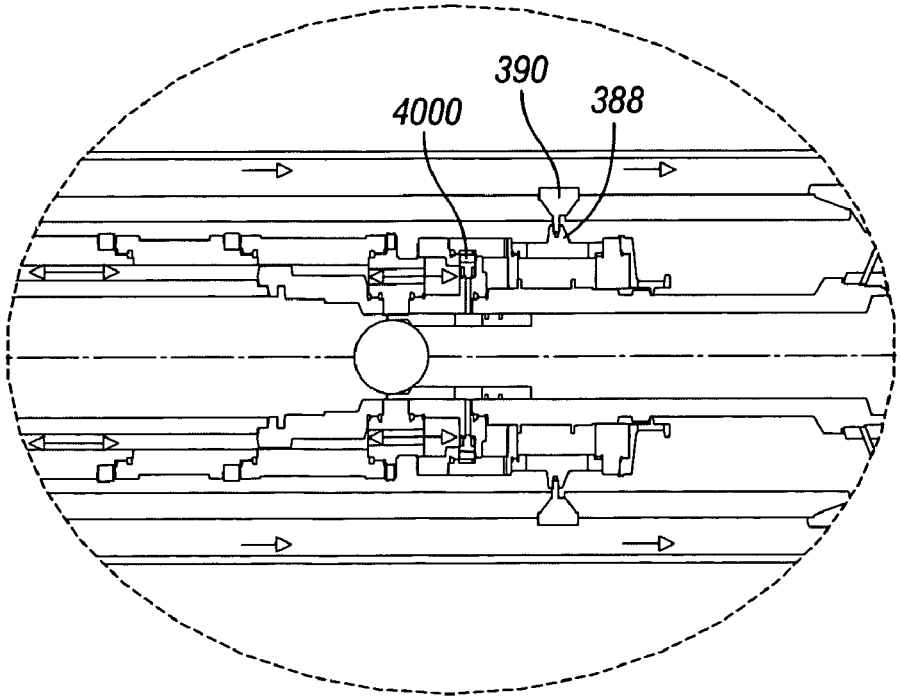

Once set, the gravel packer must be tested (step 210), and to test the packer the annular bypass port must once again be closed to isolate the annular fluid above the packer. As shown in FIG. 5, the proximal end 336 of the service tool assembly is uncoupled from the gravel packer 320, and the service tool assembly is partially retracted from within the gravel packing assembly. This movement of the service tool assembly relative to the gravel packing assembly opens the temporary closing sleeve 368, thereby allowing fluid flow between the interior channel 338 and the exterior of the gravel packing assembly. Further, this movement also causes a temporary interference collar 390 of the gravel packer assembly to engage a service tool isolation valve 388 that forms part of the service tool assembly. On further retraction of the service tool assembly, the service tool isolation valve stays substantially stationary relative to the gravel packing assembly, causing the annular bypass to once again be obstructed as shown in FIG. 5 by an interference member 4000.

Figure 6:
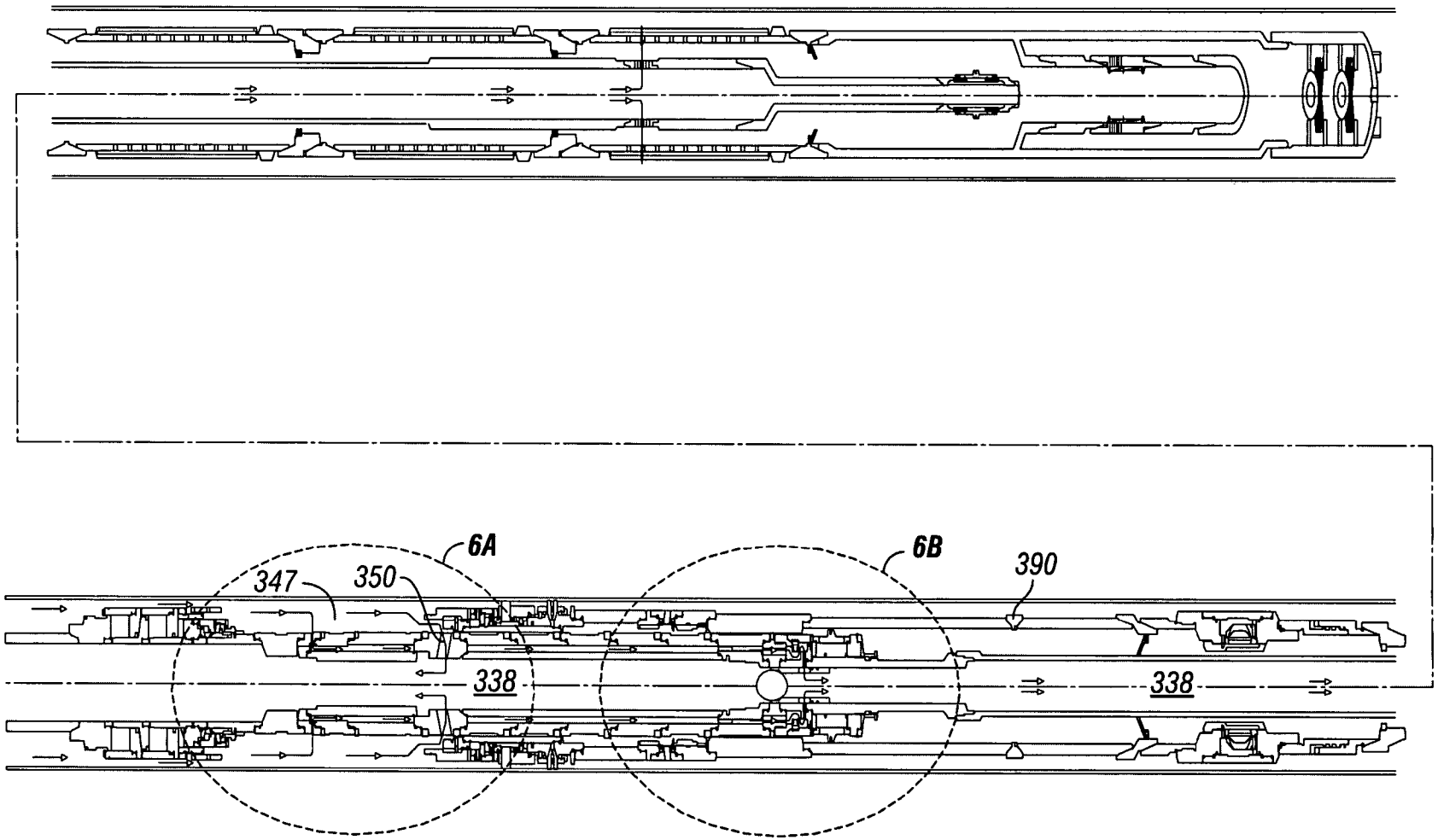
FIG. 6 illustrates a well completion tool assembly according to the present disclosure during reversing of the gravel packer.
Figure 6A:
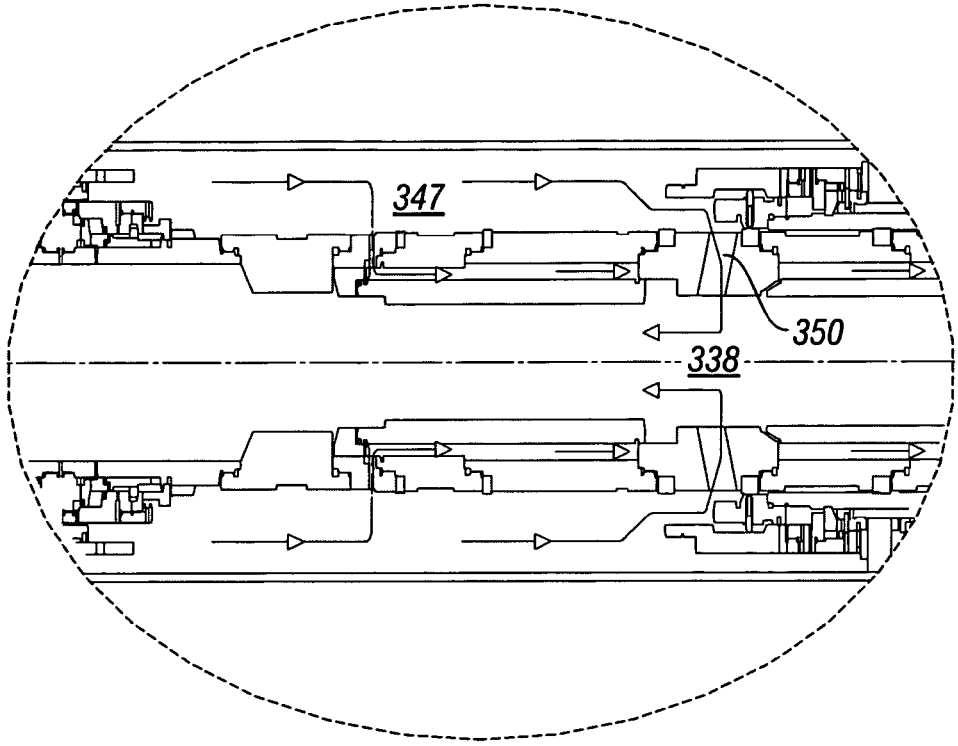
Figure 6B:
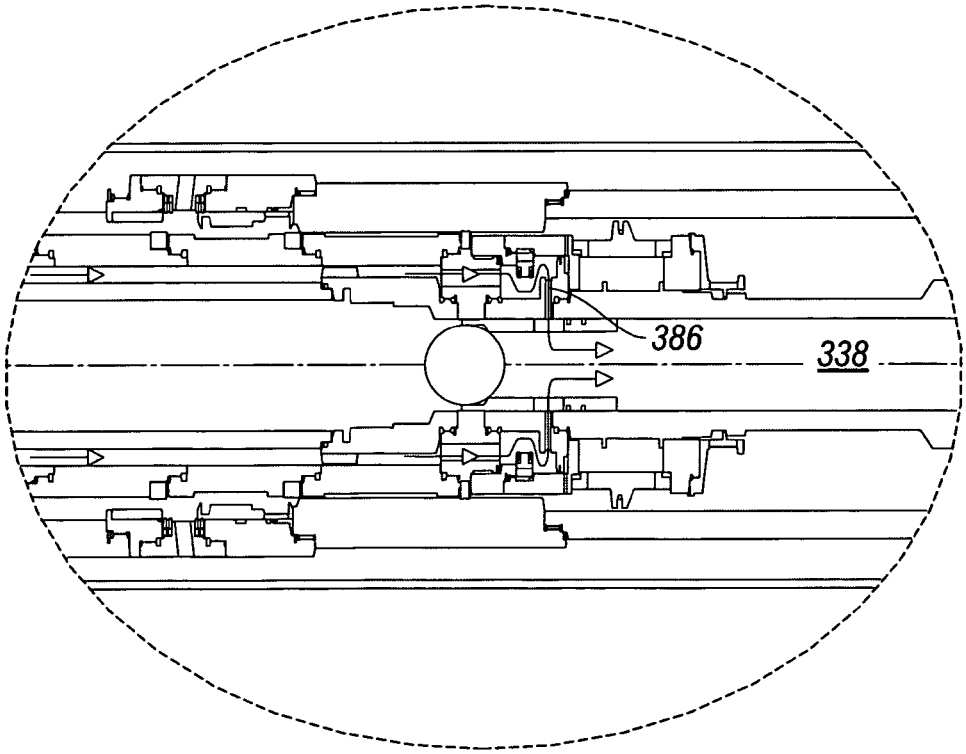

Following testing, the service tool is moved back downward removing the temporary interference collar to once again open the annular bypass 386 as shown in FIG. 6. Once this is accomplished, the service tool assembly is retracted relative to the gravel packing assembly to a point at which the cross-over tool apertures are positioned proximal of the gravel packer and form a flow path between the interior channel 338 and the first annular space. In this position fluid can be circulated at a point above the packer to avoid unnecessary exposure of the formation to such fluids. Thus, the well completion tool assembly according to the present disclosure is capable of selectively opening and closing the annular bypass port to advantageously maintain annular pressure on the formation and also to prevent pressure surges on the formation prior to and during gravel packing operations.

Figure 7:
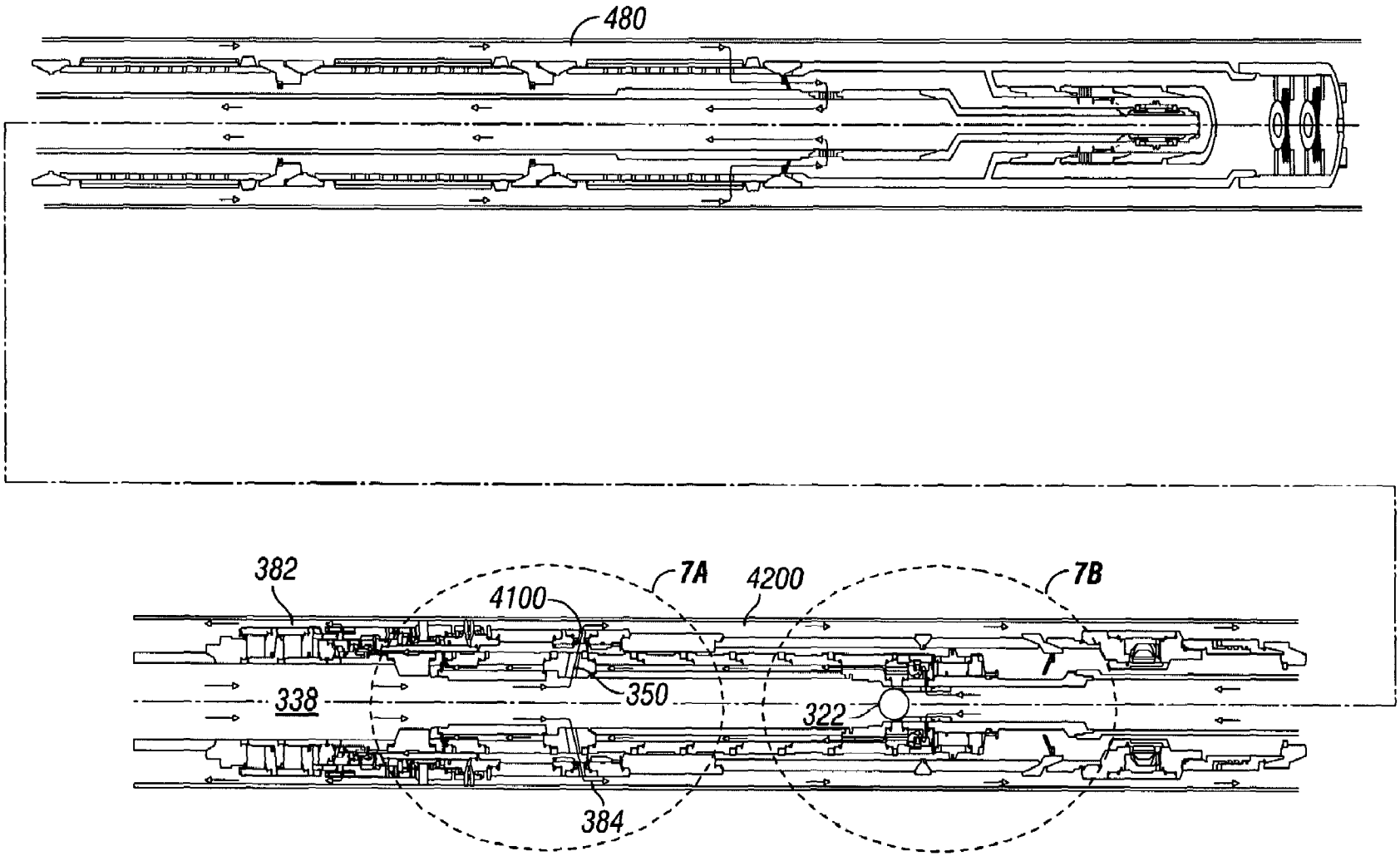
FIG. 7 illustrates a well completion tool assembly according to the present disclosure during gravel packing.
Figure 7A:
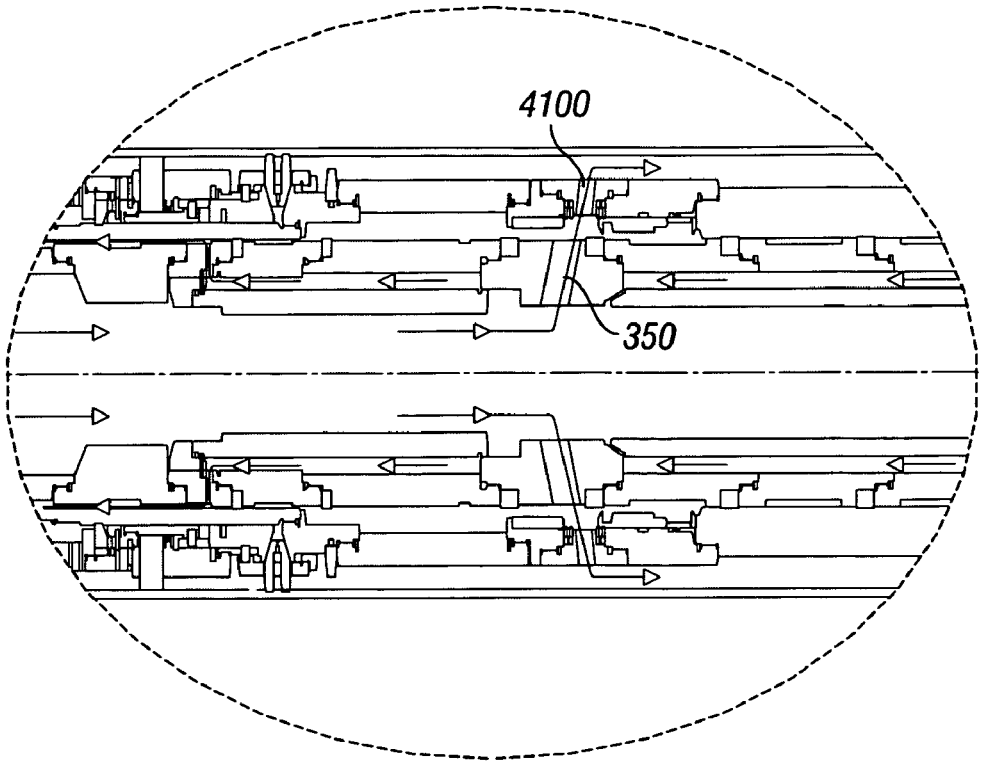
Figure 7B:
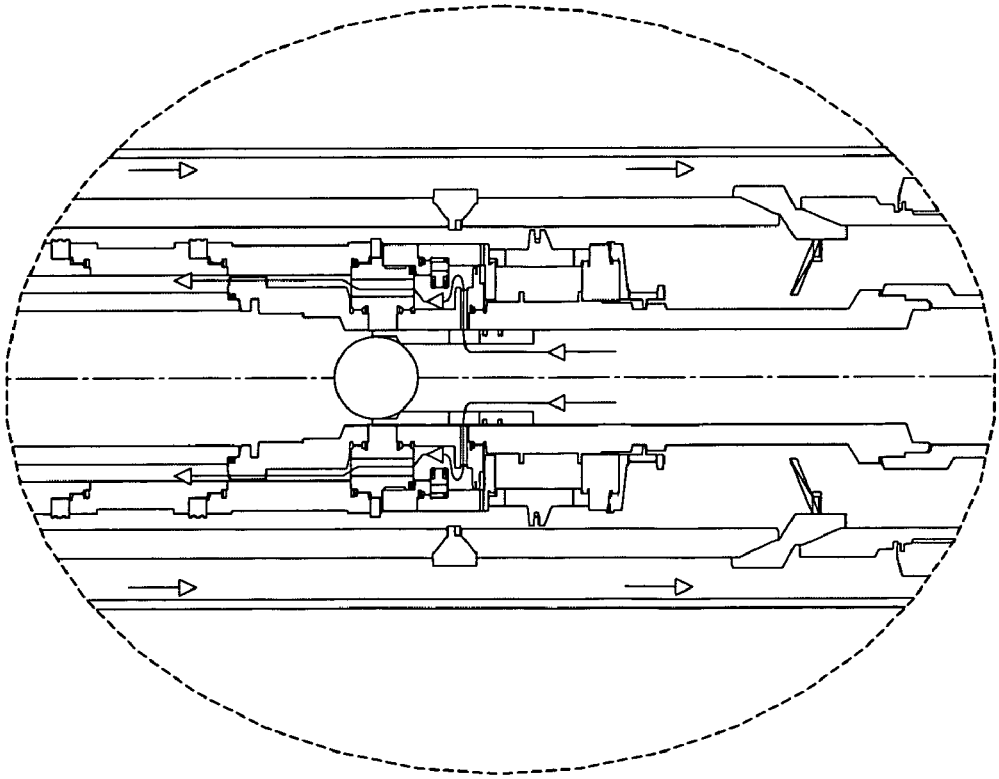

Subsequently, gravel packing is performed (step 212). As shown in FIG. 7, the service tool assembly is once again removable coupled to the gravel packing assembly by the setting tool 382. In this position, the cross-over tool apertures 350 again substantially line up with the now open gravel packing apertures 384. Thus, the fluid slurry used for gravel packing is pumped in through annular channel 338, and is diverted by the first plugging device 322 through the cross-over tool apertures 350 and gravel packing apertures 384, and out into the second annular space between the completion tool assembly and the wellbore, where it deposits sand in the production zone. Sand free fluid returns into the lower portion of the interior channel 338 through production screen 306, passes through the annular bypass port 386, internal conduit, and exterior port 399, and into the first annular space.

Once gravel packing is complete, the filter cake must be removed before oil or gas can be extracted from the surrounding formation. According to the present disclosure, the above-described completion tool assembly can also simply and easily perform well stimulation to remove the filter cake while remaining in the well.

Figure 8:
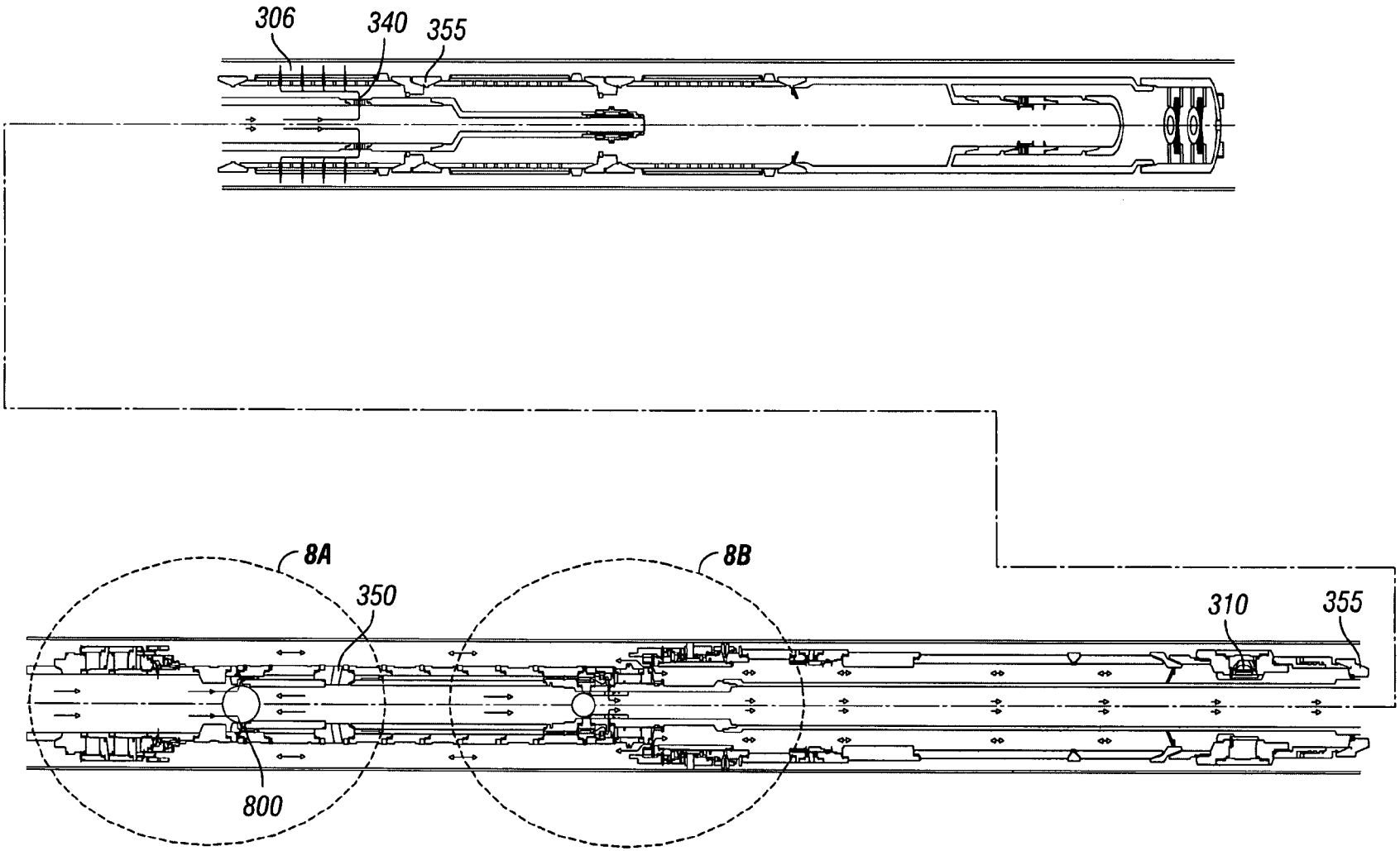
FIG. 8 illustrates a well completion tool assembly according to the present disclosure during stimulation of the well.
Figure 8A:
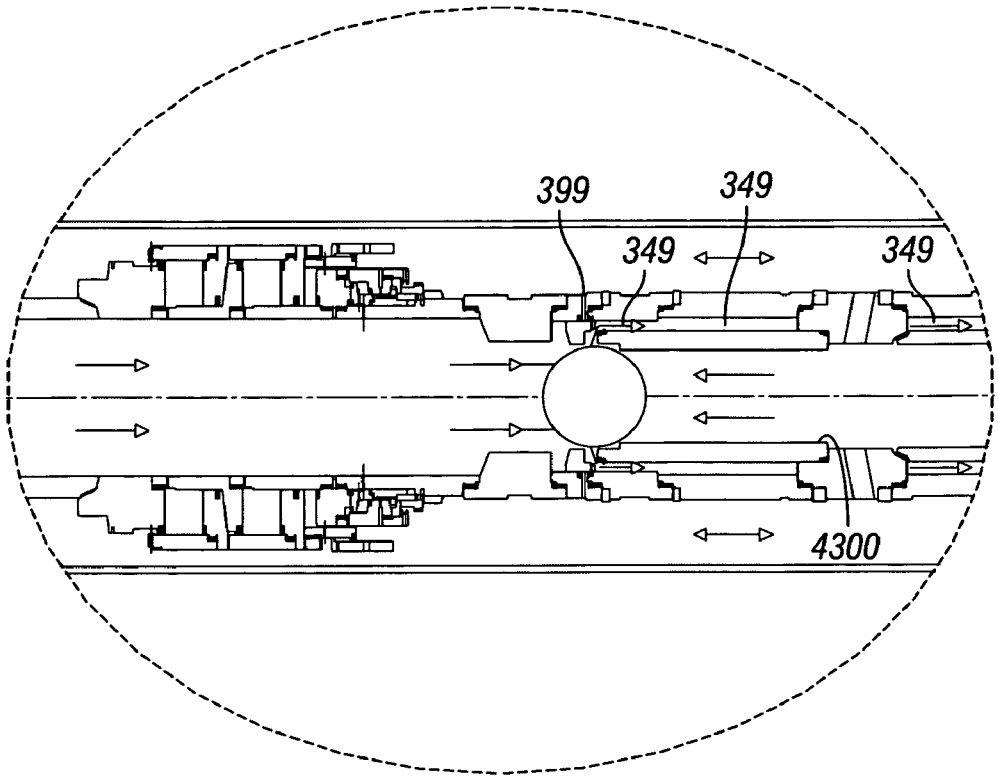
Figure 8B:
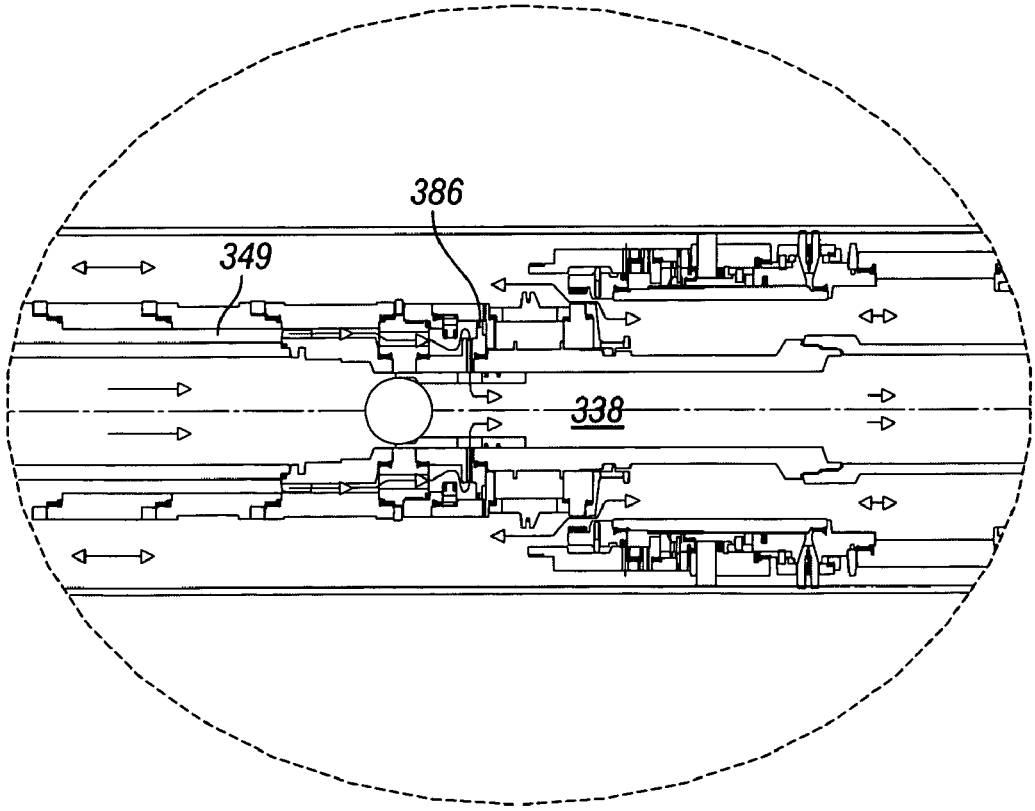

As shown in FIG. 8, a second plugging device 800 is inserted into the interior channel 338 of the service tool assembly to once again divert fluid flow (step 214). This second plugging device can be made of any suitable material, i.e., steel, and can be inserted into the service tool assembly in the same manner as described above for the first plugging device. The second plugging device, however, is of a diameter and configuration such that it forms a seal in a section of the interior channel of the service tool assembly that is above or proximal of the cross-over tool apertures 350, thereby isolating the cross-over tool apertures with plugging devices both above and below.

The interior conduit of the cross-over tool also extends between the annular bypass port and an interior port 349 into the interior channel at a location proximal of the cross-over tool aperture. This interior port is opened by a sleeve which is shifted downward by the second plugging device. This sleeve closes the annular bypass port and opens the interior port. Fluid pumped into the interior channel above the second plugging device is now diverted through the interior port 349, the interior conduit within the cross-over tool, the annular bypass port, and back into the interior channel 338 at a point below the first plugging device. Thus, fluid will once again flow into the interior channel at a point below or distal of the first plugging device, and the completion tool assembly can now be used to stimulate the well.

Stimulating fluid such as acids or solvents are pumped into the distal end of the interior chamber through the fluid path described above, where it exits the completion tool assembly through the distal apertures 340 in the service tool assembly and the production screen 306 of the gravel packing assembly. The stimulation fluid is diverted through the production screen by slick joints 355 that now seal off flow above and below the production screen. The stimulation fluid reacts with the filter cake on the surrounding wellbore to dissolve it. According to the present embodiment, the filter cake in the proximity of each screen element 306*a*, is dissolved one section at a time, optimally starting with the most distal screen section. This is done both to ensure that there is adequate pressure to force the stimulation fluid out into the filter cake, and also to ensure that the filter cake is dissolved in a controlled fashion to prevent leakage before production is ready to begin. The service tool assembly is simply retracted from within the gravel packing assembly to move from one section to the next. 035] Subsequently, the service tool assembly is removed from the well. As it is removed, flapper valve 310 closes behind it to prevent loss of oil or gas before the production tubing is in place and production is ready to begin.

Now turning to other embodiments of the present invention, as shown in FIGS. 9A-17.

Figure 9A:
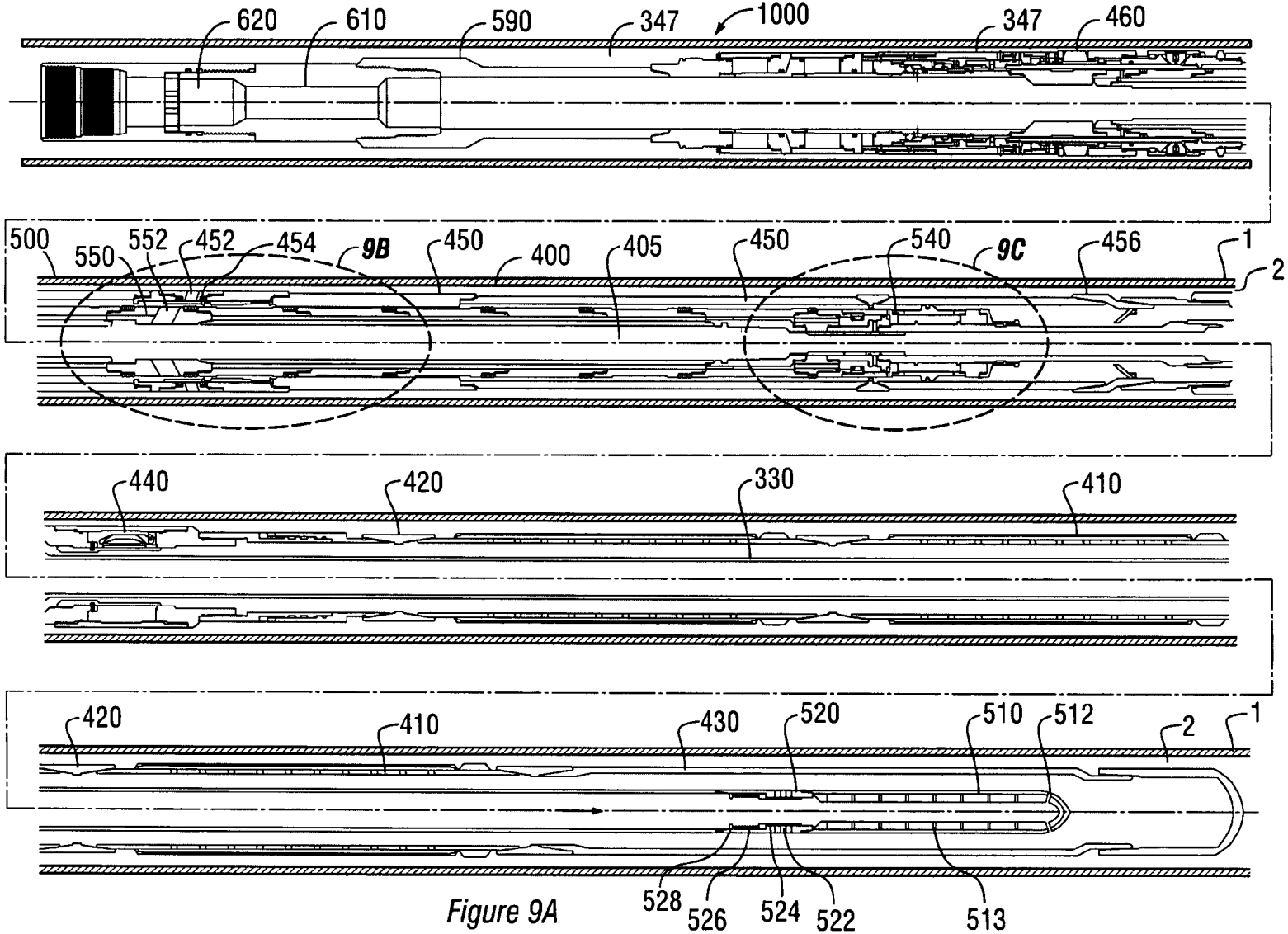
FIG. 9A shows a well completion tool assembly according to the present disclosure in the run in/wash down position, with FIGS. 9B and 9C providing detailed views of sections of FIG. 9A.
Figure 9B:
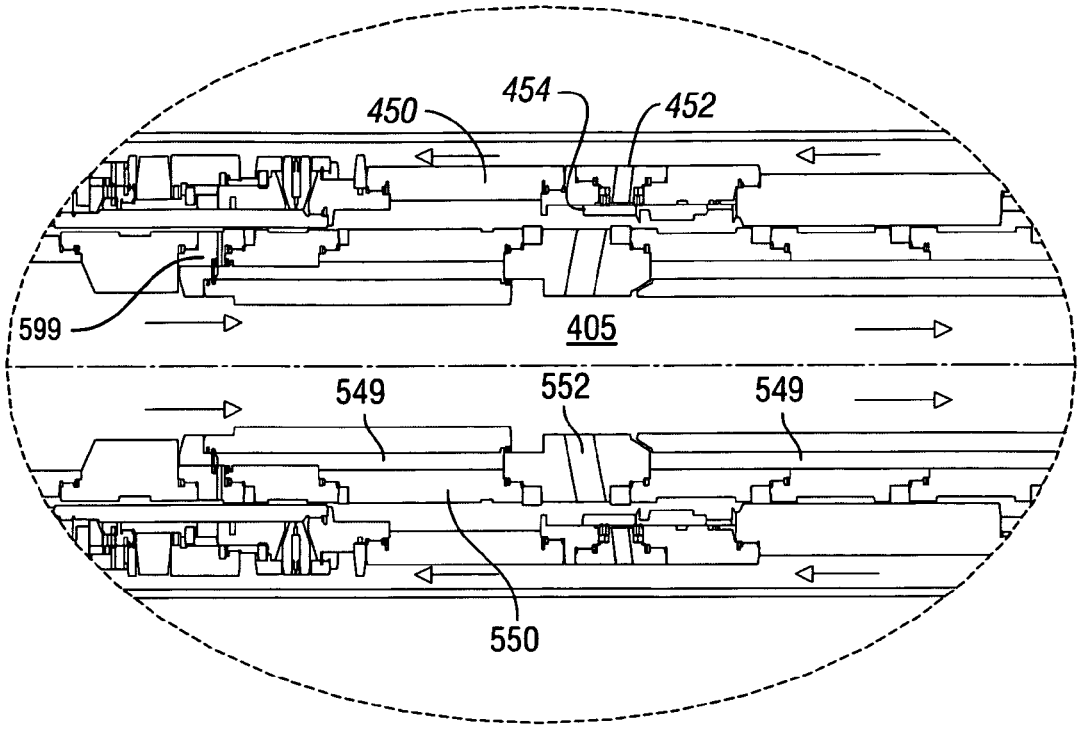
Figure 9C:
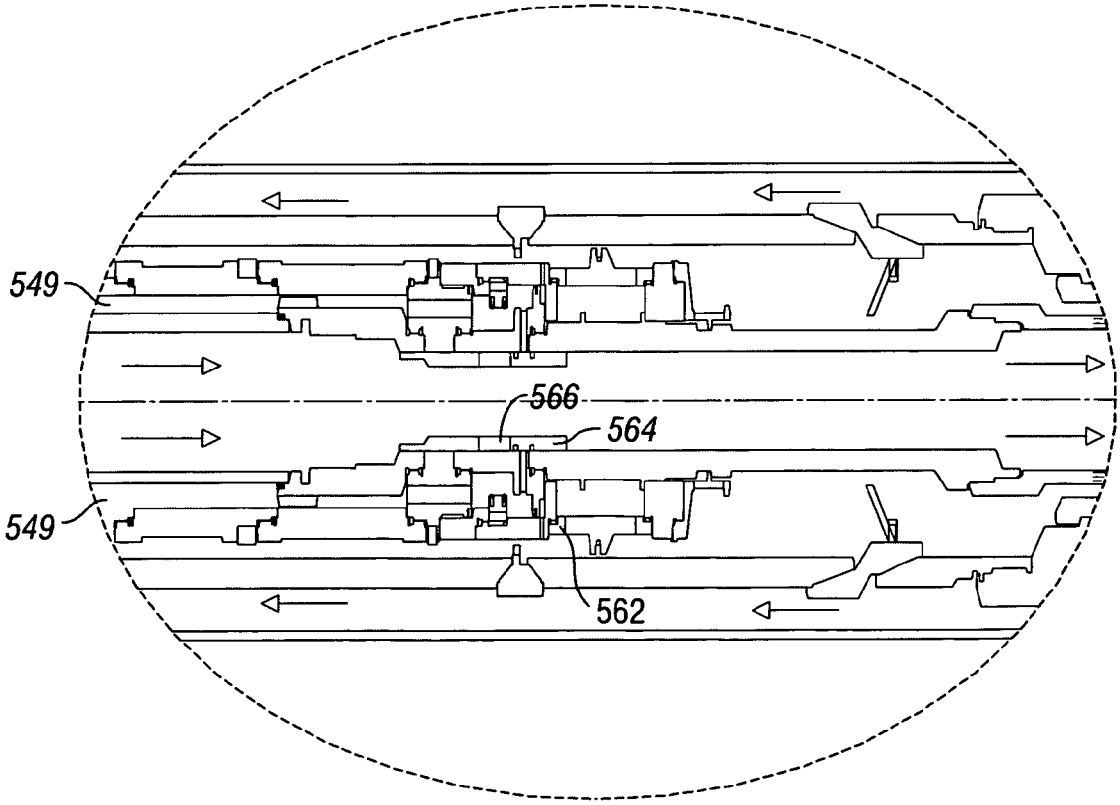

System Overview. Referring to FIGS. 9A-C, the completion tool assembly 1000 of the present disclosure is shown generally to be comprised of a gravel packing assembly 400 and a stimulation or service tool assembly 500, as discussed in greater detail in the following sections. The completion tool assembly 1000 is shown generally disposed within the wellbore 1, the wellbore 1 typically being horizontal and having filter cake previously deposited along the wellbore 1. The gravel packing assembly 400 includes a channel 405 (e.g. a passageway or bore) substantially along the length of the gravel packing assembly 400. The gravel packing assembly 400 generally comprises a bull plug 430 on a lower end, a plurality of production screens 410, a sliding sleeve 450 (having an aperture 452 therethrough), and a packer 460 to set the gravel packing assembly 400 within the wellbore 1.

The service tool assembly 500 is slidably connected to the gravel packing assembly 400 via a crossover tool 550. The service tool assembly 500 similarly has an internal channel running substantially along its length coaxial with the channel of the gravel packing assembly 400. The combined channel of the completion tool assembly 1000 will be denoted as 405 in the figures. The service tool assembly 500 may be described as generally comprising a pressure pulsating rotating jetting tool 510 connectable to a service string or washpipe 530 by a differential valve 520. The washpipe 530 may include a swivel, as would be realized by one of ordinary skill in the art. As will be described in more detail hereinafter, the ports 512 of rotating wash tool 100 are adapted to allow fluid communication from within the service tool assembly 500 outwardly, the flow being restricted in reverse. Above the pressure pulsating rotating jetting tool 510 is provided a differential valve 520.

The upper end of wash pipe 530 may be connected to a circulation valve 540 of the crossover 550. The circulation valve 540 of the crossover 550 is also connectable to the sliding sleeve 450 of the gravel pack assembly 400. The gravel pack sliding sleeve 450 includes a plurality of apertures 452 for gravel packing as described hereinafter.

It is noted that the crossover 550 may also be provided with conduits 549 running substantially parallel with the channel 405. On a lower end, the conduits 549 selectively provide fluid communication to the channel 405 via an annular bypass 562, as described hereinafter. On an upper end, the conduits 549 may selectively provide fluid communication as described hereinafter. For example, fluid communication may be provided external of the completion tool assembly 1000 into the annulus via an external port 599 of annular area 347; or fluid communication may be provided via an internal port 548.

Gravel Packing Assembly. The gravel packing assembly 400 is shown in the embodiment in FIGS. 9A-C as including at least one production screen 410. In the embodiment shown, a plurality of production screens 410 are shown on the lower of the gravel packing assembly 400. The plurality of production screens 410 are interconnected by connections 420 in the embodiment shown. As described hereinafter, sealed joints, such as inverted seal subassemblies, acting in cooperation with slick joints are neither preferable nor required in the embodiment shown, thus simplifying the construction and operation of this embodiment of the completion tool assembly 1000.

The lowermost end of the gravel packing assembly 400 includes a bull plug 430. If it is desired to perform a wash down operation with the disclosed completion tool assembly 1000, the bull plug 430 may be replaced with a float shoe, having an aperture therethrough to provide fluid communication into the lowermost end of the gravel packing assembly 400.

Gravel packing assembly 400 is shown including an interior axial channel 405 (e.g. passageway or bore), extending substantially along the entire length of the gravel packing assembly 400. Above the production screens 410 may be provided an optional safety valve 440, such as a flapper valve or ball valve assembly. The upper end of the gravel packing assembly 400 includes a packer 460. Packer 460 is adapted to selectively anchor the gravel packing assembly 400 within the wellbore. Packer 460 circumscribes sleeve 450. Sleeve 450 may include an aperture, such as a gravel packing aperture 452, for providing fluid communication therethrough as described hereinafter. Aperture 452 in the sliding sleeve 450 may be selectively closed by temporary closing sleeve 454.

Sleeve 450 may comprise a plurality of sleeves, and may further include a centralizer subassembly 456 having an inverted packer cup 458 as would be realized by one of ordinary skill in the art having the benefit of this disclosure.

The sleeve 450 on the upper end of the gravel packing assembly 400 is connectable to, and able to be manipulated by, the setting tool 590 of the service tool assembly 500. The setting tool 590 is connectable to the workstring 610 which may include a check valve 620 on an upper end. The workstring 610 is adapted to lower the completion tool assembly 1000 from surface.

Stimulation or Service Tool Assembly 500. Slidably positioned within the interior axial channel 405 of the gravel packing assembly 400 is the stimulation or service tool assembly 500. As shown in FIGS. 9A-C, a substantial portion of the length of the service tool assembly 500 is slidably positioned within the interior channel 405 of the gravel packing assembly 400. The stimulation or service tool assembly 500 is retractable relative to the gravel packing assembly 400 as described hereinafter.

The stimulation or service tool assembly 500 includes a service string or washpipe 530 coupled to a crossover tool 550. An upper end of the service tool assembly 500 includes the setting tool 590 that removably couples the service tool assembly 500 to the packer 460 of the gravel packing assembly 400 at the upper end of the completion tool assembly 1000. The upper end of the service tool assembly 500 includes the setting tool 590, also coupled to a pipe string or workstring 610, which may include a check valve 620 as described above. The workstring 610 extends to surface of the wellbore and may be utilized to manipulate the completion tool assembly 1000 as described hereinafter.

Crossover tool 550 is of a type also well known in the art. Crossover tool 550 includes at least one crossover tool aperture 552 providing a fluid flow path between the interior channel 405 and an exterior of the crossover tool 550.

Crossover tool 550 may also include a circulating valve 540. As shown in FIG. 9A, the circulating valve 560 of the crossover tool 550 is connectable to the upper end of the washpipe 530. The circulating valve 560 of the crossover tool 550 includes an annular bypass port 562 that is adapted to selectively provide communication into the internal channel 405. A temporary closing sleeve 564 having and aperture 66 provides selective communication through the circulating valve 560 of the crossover tool 550 to the internal channel 405 as described hereinafter. The upper end of the circulating valve 560 may further comprise a ball seat 568, also as described hereinafter. The crossover tool 500 also includes separate internal conduits 549 that form a fluid flow path between the annular bypass port 562 that opens into the interior channel 405 at a location below the crossover tool apertures 552 and either (1) an exterior port 599 that opens to the exterior of the crossover tool 550 to the annulus 347 at a location proximal or above the crossover tool apertures 552 or (2) an interior port 548 that opens to the interior of the crossover tool 550 to the channel 405 at a location proximal or above the crossover tool apertures 552.

Located below the circulating valve 560 of the crossover 550 is the service string or washpipe 530. Located on the lower end of the washpipe 530 is a rotating jetting tool 510, which may be adapted to produce pressure pulsating jets. An example of such a tool is the Roto-Jet® Rotary Jetting Tool by BJ Services Company of Houston Tex. The operation of such a rotary jetting tool is described more fully in "Roto-Jet® Rotary Jetting Tool Product Sales Bulletin," incorporated by reference in its entirety herein.

The rotating jetting tool 510 includes a plurality of ports 512 on a mole 513. The ports 512 are preferably angled as shown, through which jets of stimulation fluid may pass. The rotating jetting tool 510 is adapted to be rotated downhole by a drive mechanism, such as a downhole turbine 515 (not shown in the FIG. 9A, but shown in FIG. 17), the use of which would be known to one of ordinary skill in the art having the benefit of this disclosure. The turbine 515 is utilized as an internal drive mechanism to drive a mole 513, which spins a plurality of ports 512 mounted on the mole 513.

The rotating jetting tool assembly 510 is connectable to the washpipe 530 of the service or stimulation tool assembly 500 by a differential valve 520; the rotating jetting tool assembly 510 is not being connected to coiled tubing in this embodiment. Thus, the stimulation of relatively deep horizontal wells may be accomplished with embodiments of the invention disclosed herein (i.e wells in which coiled tubing is not effective to run the rotating jetting tool, due to the depth of the hole).

The stimulation tool 500 is provided in the embodiment shown with a reclosable circulation valve or differential valve 520. The differential valve 520 may comprise a plurality of ports 522 in a housing adapted to allow fluid communication therethrough. A sleeve 524 may be biased to close the ports 522 (e.g. biased downwardly) by a biasing means such as spring 526. The biasing means such as spring 526 abut a flange 528. The differential valve 520 is connectable to washpipe 530.

As described more fully hereinafter, in order to perform the step of gravel packing, returns are to pass from the annulus 2, through the production screens 410, and up through the washpipe 530 to the interior of the completion tool assembly 1000. Typical pressure pulsating rotating jetting tools 510 generally allow fluid flow from within the tool, outwardly through the ports 512, and into the surrounding gravel pack; however, flow in the reverse is restricted, due to the geometry of the rotating jetting tool ports 512. The differential valve 520 is designed to open a differential pressure exits from outside the valve 520 (i.e. when the pressure outside the valve is greater than the pressure within the valve 520). When fluid is pumped within the differential valve, the valve is adapted to close.

The differential valve also increases the flow rate of returns during the gravel packing operation. Fluid flow during gravel packing operations in horizontal wells is known to present challenges. The increased flow rate of the returns provided by the use of the differential valve 520 is advantageous when the tool is utilized in a horizontal well. Thus, the unrestricted flow path for the returns, provided by the differential valve, provides a competitive advantage when utilizing the stimulation tool in horizontal wells.

Further, without the differential valve 520 selectively opening to allow returns during the gravel packing operations, the gravel packing operation generally would not be possible, as fluid flow would not generally be possible. The differential valve 520 is adapted to operate such that fluid communication is provided therethrough thus opening the valve, when differential pressure exists from outside the tool to inside, as would be known by one of ordinary skill in the art having the benefit of this disclosure.

Again, the differential valve 520 includes a plurality of ports 522 through the valve 520. A sleeve 524 circumscribes the valve 520 and operates to selectively open and close the ports 522 in the differential valve 520. Means for biasing the sleeve 525 in the closed position, such as spring 526, for example, is provided. In the embodiment shown, the sleeve 525 is biased to close the ports 522, as the spring 526 is in compression, one end resting against the flange 528 on the valve 520 and the other end contacting the sleeve 520.

The jetting rotating tool 510 is adapted to force the stimulation/treatment fluids through the pore space of the gravel pack and onto the filter cake. The chemicals are driven through the gravel pack by a high velocity pulsed jets from the rotating tool 510. Thus, jetting rotating tool 510 facilitates the filter cake cleanup and stimulation by treating the horizontal interval of a wellbore. The rotating high jet velocity jetting tool 510 uses the mechanical energy of the high pressure rotating jets to force the treatment fluid through the production screens, thus creating a mechanical diversion, thus allowing the filter cake to be removed without damaging the gravel pack.

By combining the single-trip gravel packing system described above with the improved cleaning performance of a pressure pulsating rotating jetting tool 510, increased system performance may be attained. Additional advantages of embodiments of this disclosure exist. For instance, a spacing advantage is provided by the embodiments disclosed. With slick joints/seal subs, twenty foot connections typically are connected to the perforated pipe, with seal subs being spaced on the connections. The slick joints are constructed to mate with the seal subs on either end. The seal subs are therefore generally spaced at a predetermined interval to mate with a given slick joint. In the disclosed embodiment, as the rotating jetting tool may be continuously pulled out of hole, the tool 510 does not need to be adapted to mate with the seal subs. As such, the production screens may be spaced at any desired interval; and intervals between the production screens do not have to be identical or even substantially similar (e.g. to mate with a given slick joint). This provides a spacing advantage.

Further, the rigtime for utilizing the embodiments disclosed herein may be reduced, as fewer tools are required to be run downhole. Also, pumping of the stimulation fluid may be continuous with the use of the rotating jetting tool 510; i.e. the tool disclosed in the embodiments herein does not require the cessation of pumping while pulling uphole.

Also, because the less equipment is needed at the site, further costs advantages exist. In some operations, the rotating jetting tool such as the Roto-Jets may be rented, instead of purchased, for use, again saving capital expenditures for a given job. Finally, the use of the tool as described in some embodiments allows for relatively deep horizontal wells be to stimulated, wells that may be typically too deep or otherwise inappropriate for the use with coiled tubing.

Construction of Completion Tool Assembly. To assemble the completion tool assembly 1000, the gravel packing assembly 400 (e.g. bull plug 430, screens 410, connections 420, and sleeve 450) are run downhole, until the upper end of the sliding sleeve 450 extends above the rotating table at surface. Next, components of the stimulation tool assembly 500 are inserted into the gravel packing assembly 400. Once extended within gravel packing assembly 400, the service tool assembly 500 is connected via the crossover 550 to the gravel packing assembly 400. Once connected, the work string 610 is connected to the setting tool 590 of the service tool assembly 500 and the entire completion tool assembly 1000 is run downhole to a desired position.

Operation of Embodiments

The completion tool assembly 1000 described generally above, will now be discussed during the various stages of operation.

Run-In. Referring to FIGS. 9A-C, an embodiment of the present completion tool assembly 1000 is shown comprising a gravel packing assembly 400 and a stimulation tool assembly 500. The wellbore 1 may comprise a horizontal wellbore having filter case in place, as described above.

FIG. 9 shows an embodiment of the present invention while being run in the wellbore 1. In the configuration shown in FIG. 9A, the circulation valve 540 is closed. Thus, fluid downhole passes through the screens 410 and seeps through the ports 512 of the pressure pulsating rotating jetting tool 510 and into the wash pipe 530. Alternatively, if the bull plug 430 is replaced with the float shoe having an aperture on a lower end, downhole fluid may exit the tool through the aperture in the float shoe instead of through the production screens 410.

Washdown. With the gravel packing assembly 400 and service tool assembly 500 in position within the wellbore as shown in FIGS. 9A-C, washdown operations may be performed, if desired, to remove any remaining drilling fluid or debris from the service tool assembly 500 by pumping clean fluid therethrough. The fluid flow path during washdown is illustrated by the arrows in FIGS. 9A-C.

As shown, fluid flows in a substantially unobstructed path through an interior channel 405 in the service tool assembly. The fluid flows out into the well area through apertures 512 in the pressure pulsating rotating jetting tool 510 at the lower end of the service tool assembly 500 and through the gravel packing assembly 400 through, e.g., an aperture on the lower end of a float shoe (if used instead of the bull plug 430) or through the production screens 410 of the gravel packing assembly 400 and back in the annular space 2 between the completion tool assembly 1000 and the wellbore 1 that, before setting of the packer 620, is present along the entire length of the completion toll assembly 1000. In this manner, the service tool assembly 500 and the outer annular area 2 between the gravel packing assembly 400 and the casing/formation 1 may be flushed clean of any remaining drilling fluid or debris.

Gravel Packing—Set Packer. When it is desired to perform gravel packing operations, the completion tool assembly 1000 described herein can simply and readily perform the gravel packing operation in addition to the other operations described herein. As indicated above, during washdown, the interior channel 405 of the service tool assembly 500 is substantially unobstructed.

Figure 10A:
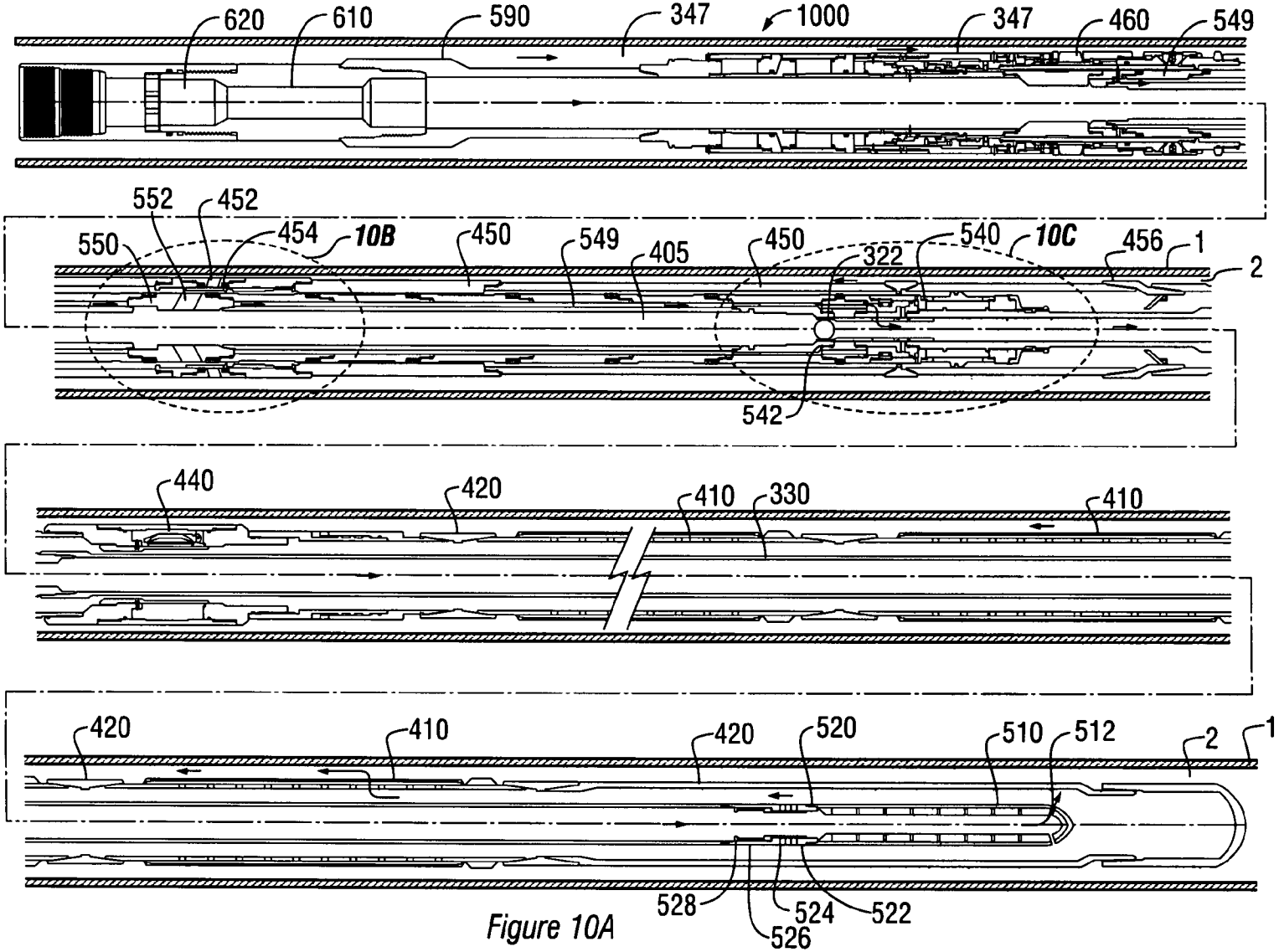
FIG. 10A shows a well completion tool assembly according to the present disclosure in the open annulus/set packer position, with FIGS. 10B and 10C providing detailed views of sections of FIG. 2A.
Figure 10B:
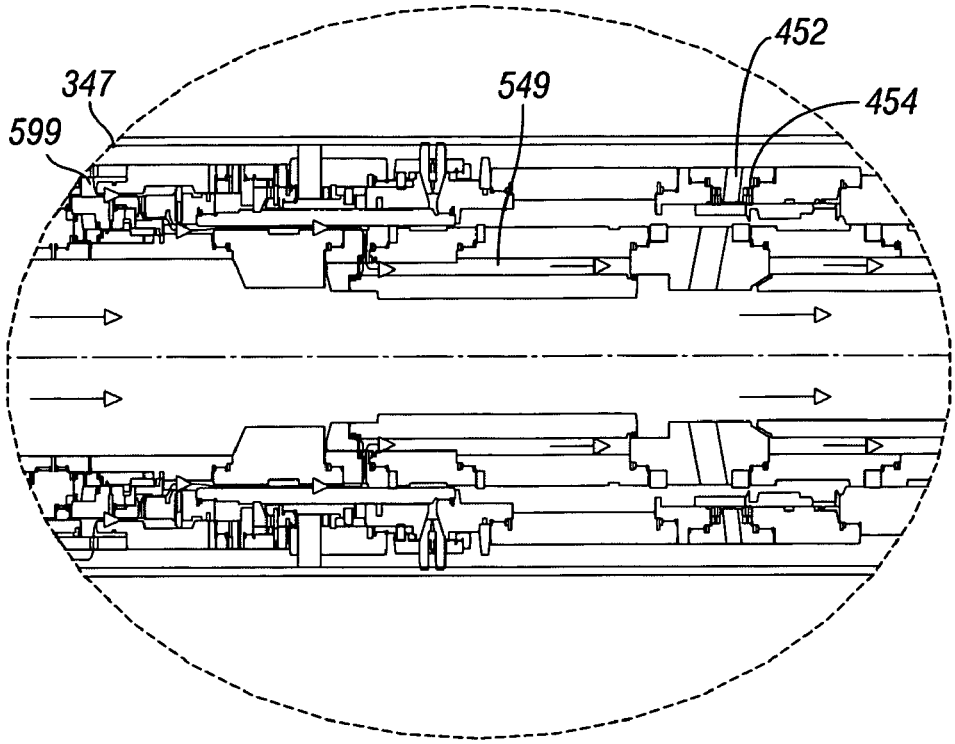
Figure 10C:
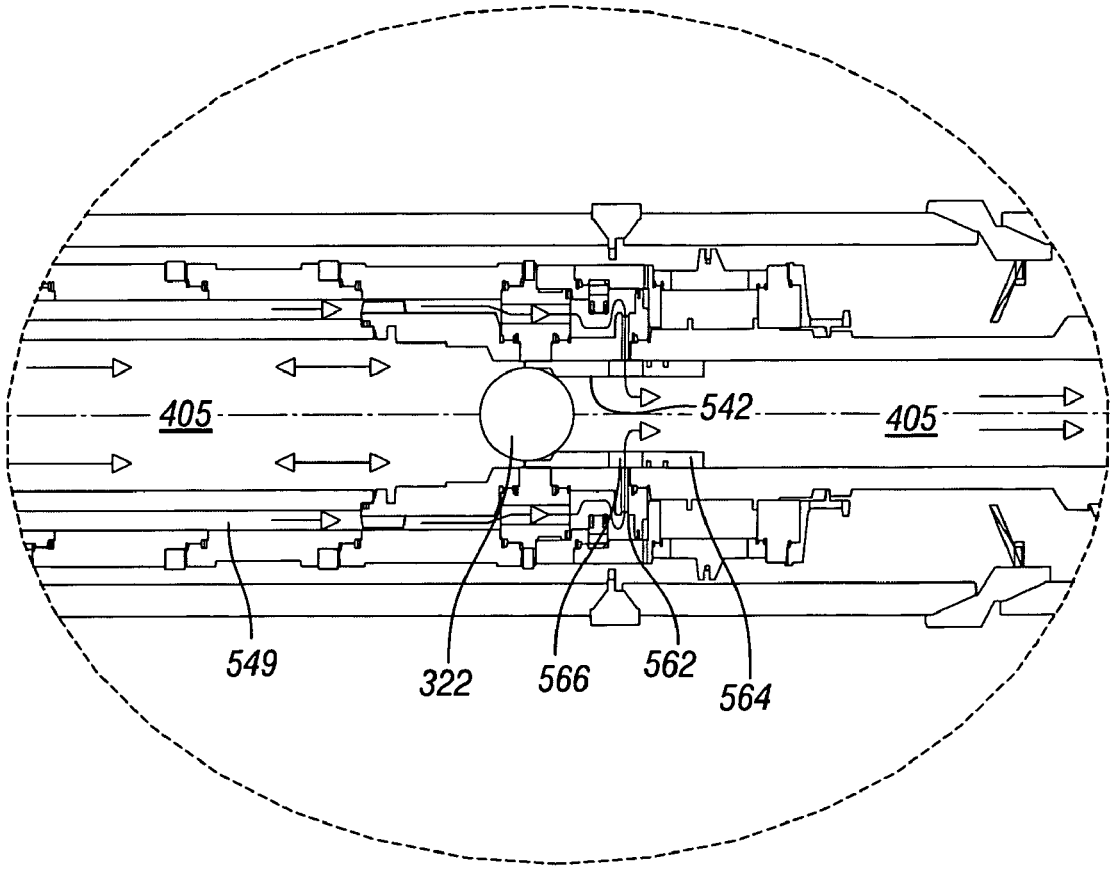

Referring to FIGS. 10A-C, to set the packer 460 according to the present system and method, a first plugging device 322 is inserted into the interior channel 405; as the first plugging device 322 travels downwardly, the first plugging device 322 forms an obstruction in the ball seat 542 of the circulation valve 540 of the crossover 550 and diverts the fluid path to enable setting of the packer 460. The first plugging device 322 may be made of any suitable material and of any suitable configuration such that it will substantially prevent fluid from flowing through the interior channel 405 past the first plugging device 322. According to one embodiment, the first plugging device 322 is a spherical steel ball, which may be inserted into place by dropping it into the annulus of the work string 610 at surface. The first plugging device travels downwardly via gravity and fluid flow into the circulation valve 540 of crossover 550 of the service tool assembly 500. The ball seat 542 of the circulation valve 540 may also be positioned within the interior channel of the service tool assembly 500 to help retain the first plugging device 322 in the proper position.

As shown and described above, the gravel packing assembly 400 has at least one gravel packing aperture 452 in the sliding sleeve 450 that, when the service tool assembly 500 is removably coupled to the gravel packing assembly 400, is aligned with the crossover tool aperture 552 such that fluid may flow from the interior channel 405 and through both apertures 452, 552 when unobstructed. The temporary closing sleeve 454, however, controls fluid flow through the gravel packing assembly aperture 452, and is in the closed position during setting of the packer 460 as shown in FIG. 10B. Thus, during setting of the packer 460, the first plugging device 322 obstructs fluid flow through the interior channel 405, and because the temporary closing sleeve 454 is also closed, fluid pressure within the interior channel 405 of the service tool assembly 500 builds up in the vicinity of the packer 460 sufficiently to force the packer 460 outwardly against the wellbore 1, thereby setting the packer 460 against the wellbore 1. These techniques are well known in the art. Fluid flow during the setting of the packer is shown in FIGS. 10A-C.

In some embodiments, the completion tool assembly 1000 of the present disclosure is also able to maintain annular pressure on the well formation during setting of the packer 460. In these embodiments, the well completion tool assembly 1000 includes an annular bypass closing mechanism for selectively opening and closing the annular bypass port 562. According to one embodiment, this annular bypass closing mechanism includes a device, such as a temporary closing sleeve 564, positioned within the interior channel that is slidable relative to the interior channel 405 between open and closed positions. The device 564 is configured so that when in the closed position, it obstructs the annular bypass port 562 (preventing fluid communication between conduit 549 and interior channel 405), and when slid into the open position it is configured so as not to obstruct the annular bypass port 562. According to one embodiment, the device is the temporary sleeve 564 in the circulation valve 540 of crossover 550, and includes the primary ball seat 542.

Seating of the first plugging device 322 within the primary ball seat 542 causes the primary ball seat 542 of the circulating valve 540 to slide sufficiently so that an opening 566 in the temporary closing sleeve 564 therein becomes substantially aligned with the annular bypass port 562 so as not to obstruct the annular bypass port 562. Thus, fluid may freely flow from a first annular space 347 proximal of the packer 460, through the external port 599, through the crossover tool conduit 549, through the opening 566 in the closing sleeve 564, and into the interior channel 405 at a location below the first plugging device 322. Thus, annular pressure is maintained on the formation to help maintain its integrity prior to gravel packing operations.

Figure 11A:
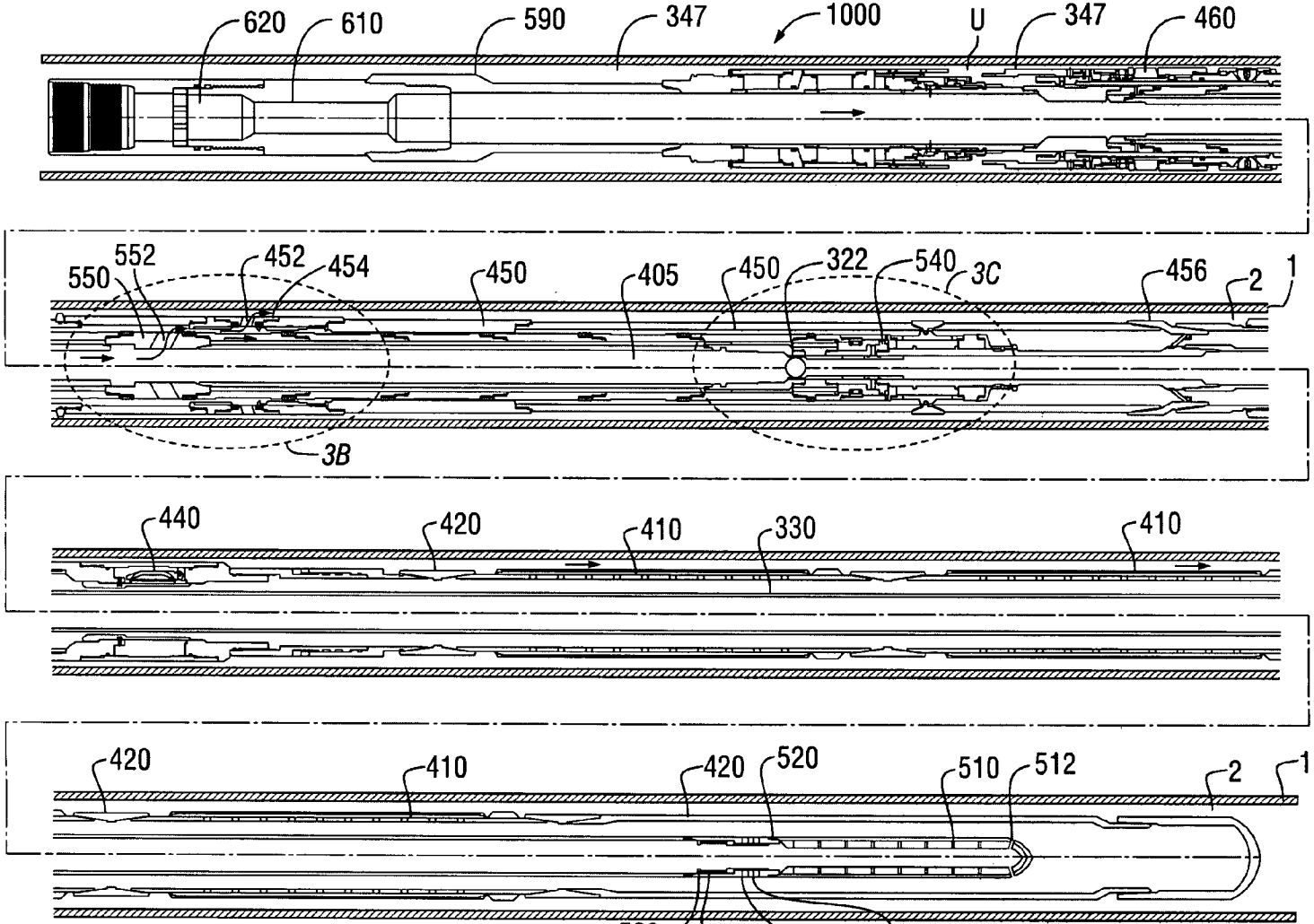
FIG. 11A shows the well completion tool assembly according to the present disclosure during the test packer operation, with FIGS. 11B and 11C providing detailed views of sections of FIG. 11A.
Figure 11B:
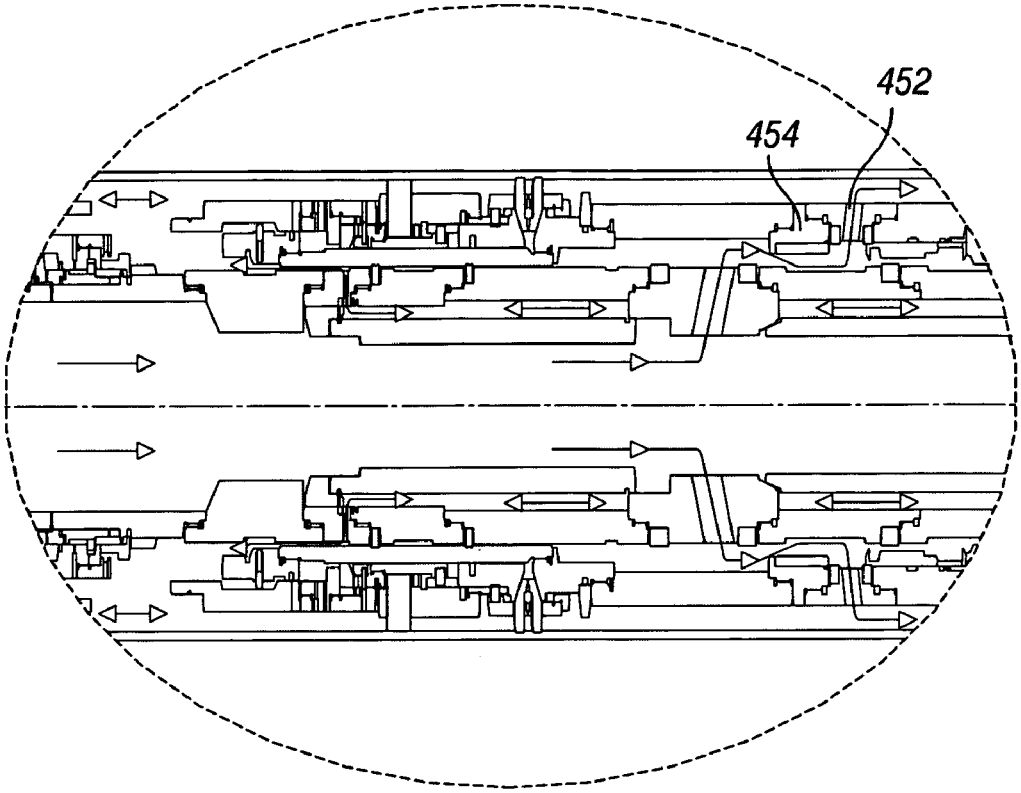
Figure 11C:
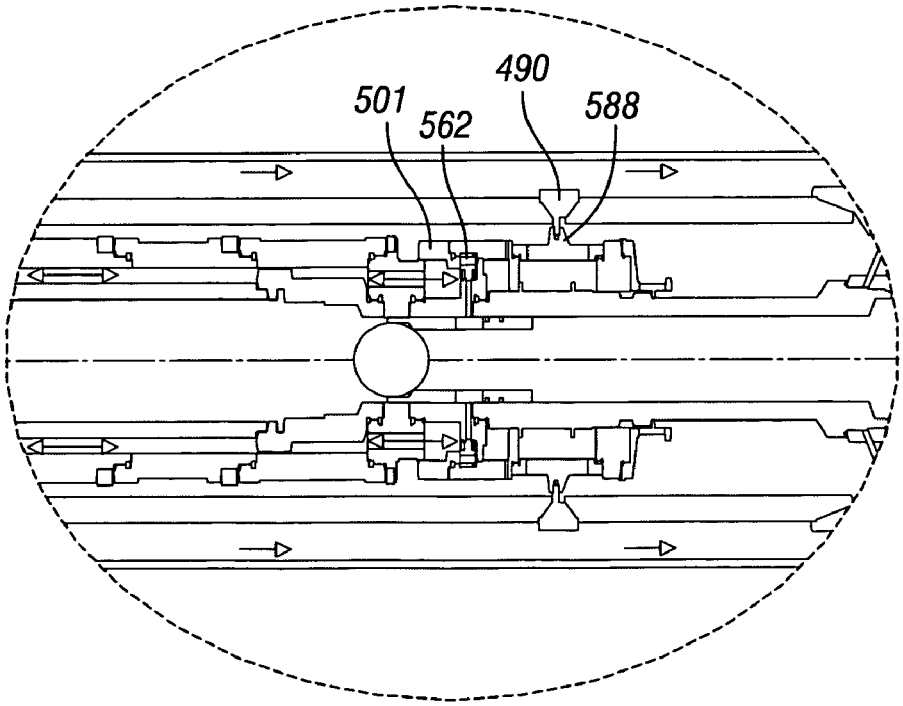

Gravel Packing—Test Packer. Referring to FIGS. 11A-C, once set, the packer 460 is tested. To test the packer 460, the annular bypass port 562 must once again be closed to isolate the annular fluid above the packer 460. As shown in FIGS. 11A-C, the upper end of the service tool assembly 500 is uncoupled (as shown at "U") from the gravel packer 320, and the service tool assembly 500 is partially retracted from within the gravel packing assembly 400, by pulling upwardly on the workstring 610. This upward movement of the service tool assembly 500 relative to the gravel packing assembly 400 opens the temporary closing sleeve 454, thereby allowing fluid flow between the interior channel 405 and the exterior of the gravel packing assembly 400 through aperture 452 as shown in FIG. 1B. Further, this movement also causes a temporary interference collar 490 of the gravel packer assembly 400 to engage a service tool isolation valve 588 that forms part of the service tool assembly 500. On further retraction of the service tool assembly 500, the service tool isolation valve 588 remains substantially stationary relative to the gravel packing assembly 400, causing the annular bypass 562 to once again be obstructed by interference member 501 as shown in FIG. 11C. In this way, the packer may be tested to ensure the packer is properly energized.

Figure 12A:
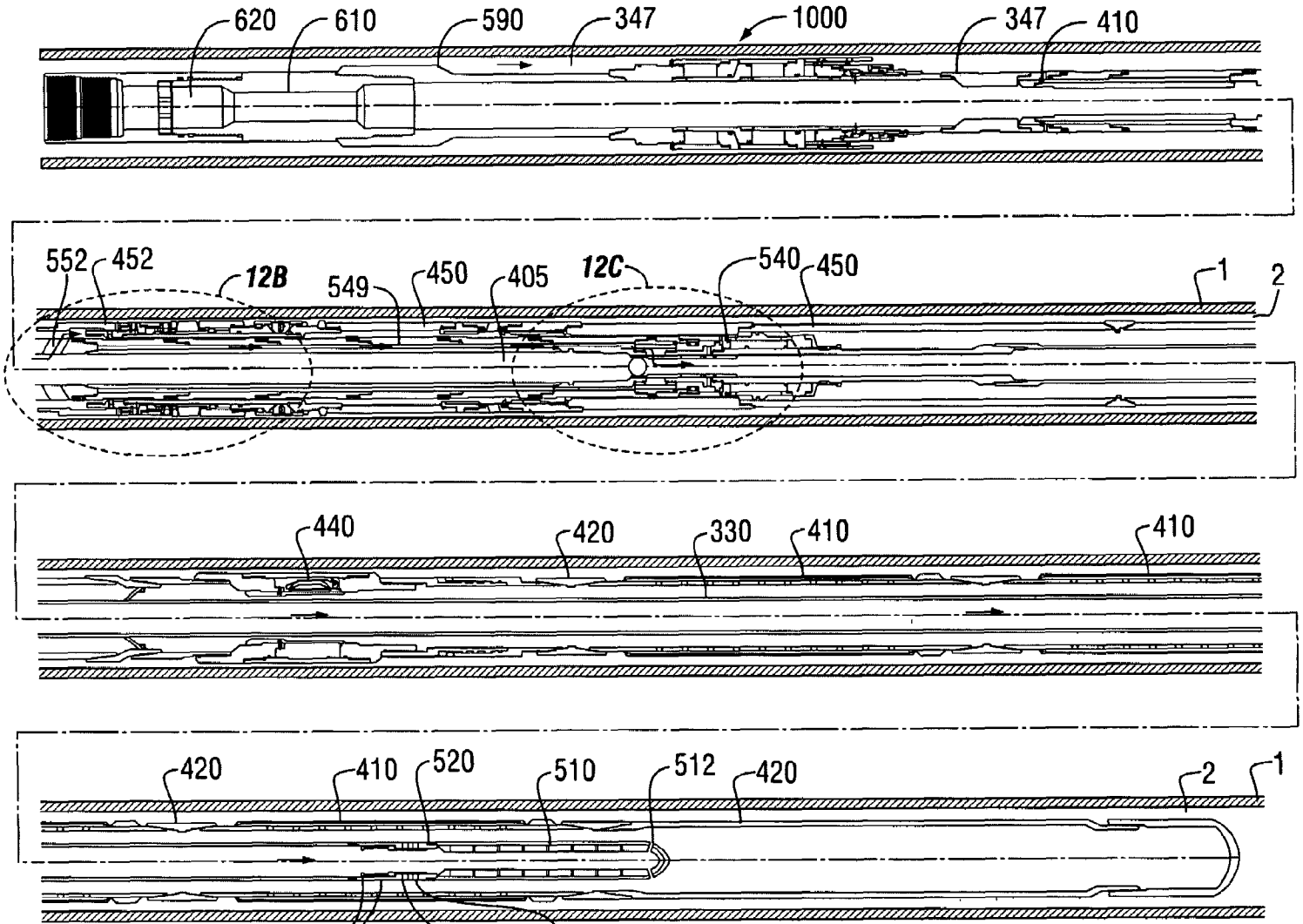
FIG. 12A shows a well completion tool assembly according to the present disclosure during reversing of the gravel packer, with FIGS. 12B and 12C providing detailed views of sections of FIG. 12A.
Figure 12B:
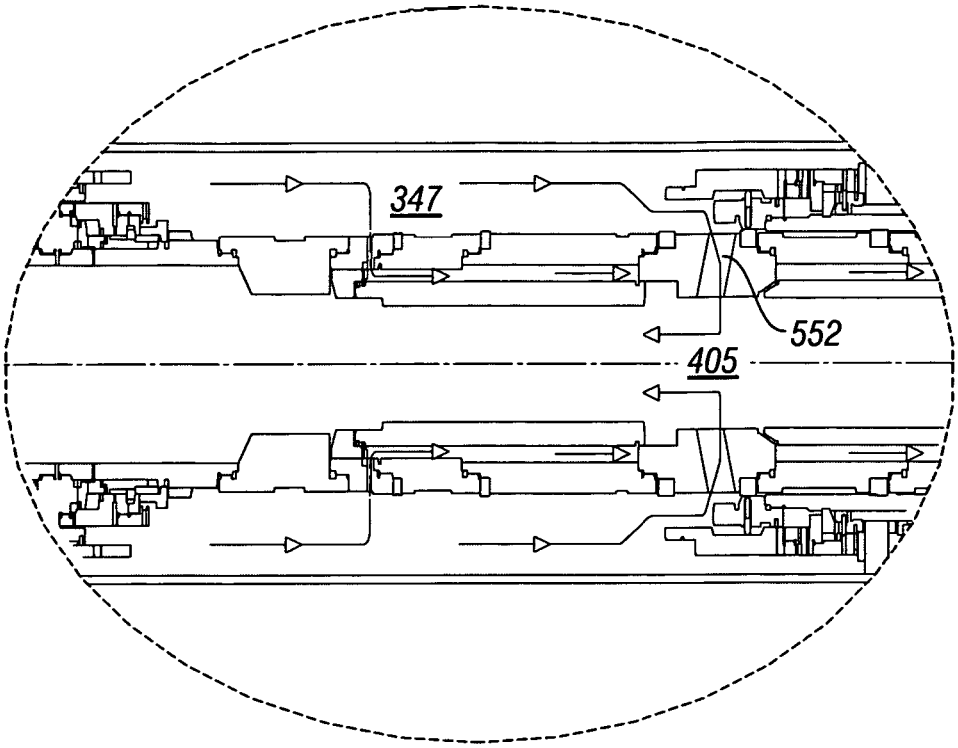
Figure 12C:
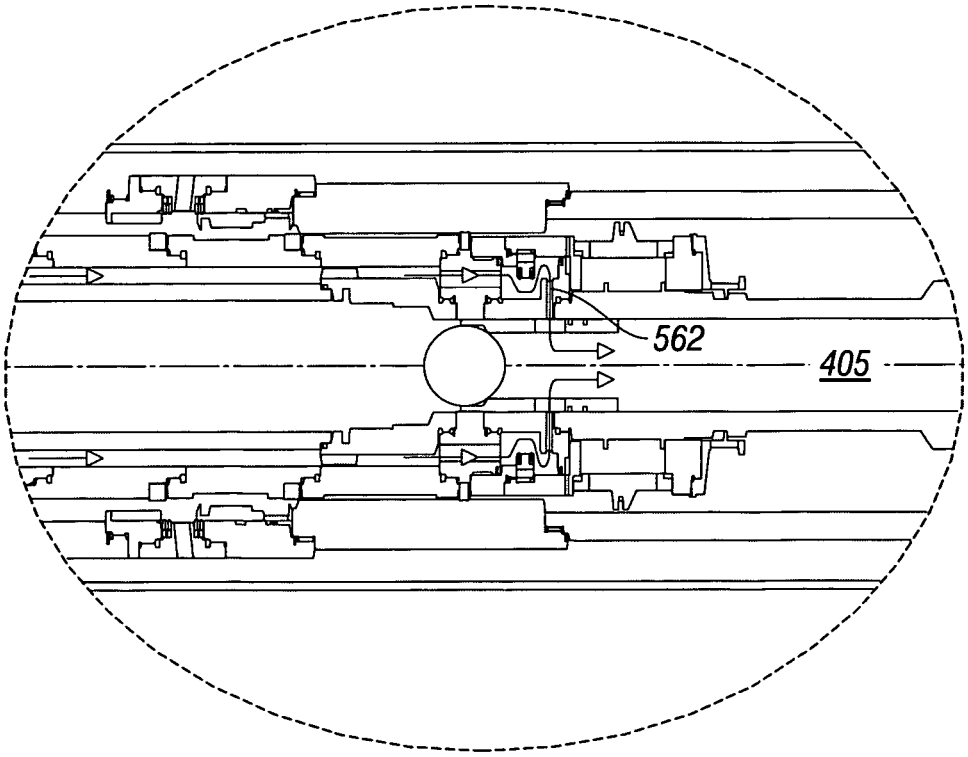

Reversing. Referring to FIGS. 12A-C, following testing, the service tool assembly 500 is moved back downward removing the temporary interference collar 501 from contact with the service tool isolation valve 588 to once again open the annular bypass 562 as shown in FIGS. 12A and 4C. Once this is accomplished, the service tool assembly 500 is retracted relative to the gravel packing assembly 400 to a point at which the crossover tool apertures 552 are positioned proximal of the packer 460 and form a flow path between the interior channel 405 and the first annular space 347. In this position fluid can be circulated at a point above the packer 460 to avoid unnecessary exposure of the formation to such fluids. Thus, the well completion tool assembly 1000 according to the present disclosure is capable of selectively opening and closing the annular bypass port 562 to advantageously maintain annular pressure on the formation and also to prevent pressure surges on the formation prior to and during gravel packing operations.

Figure 13A:
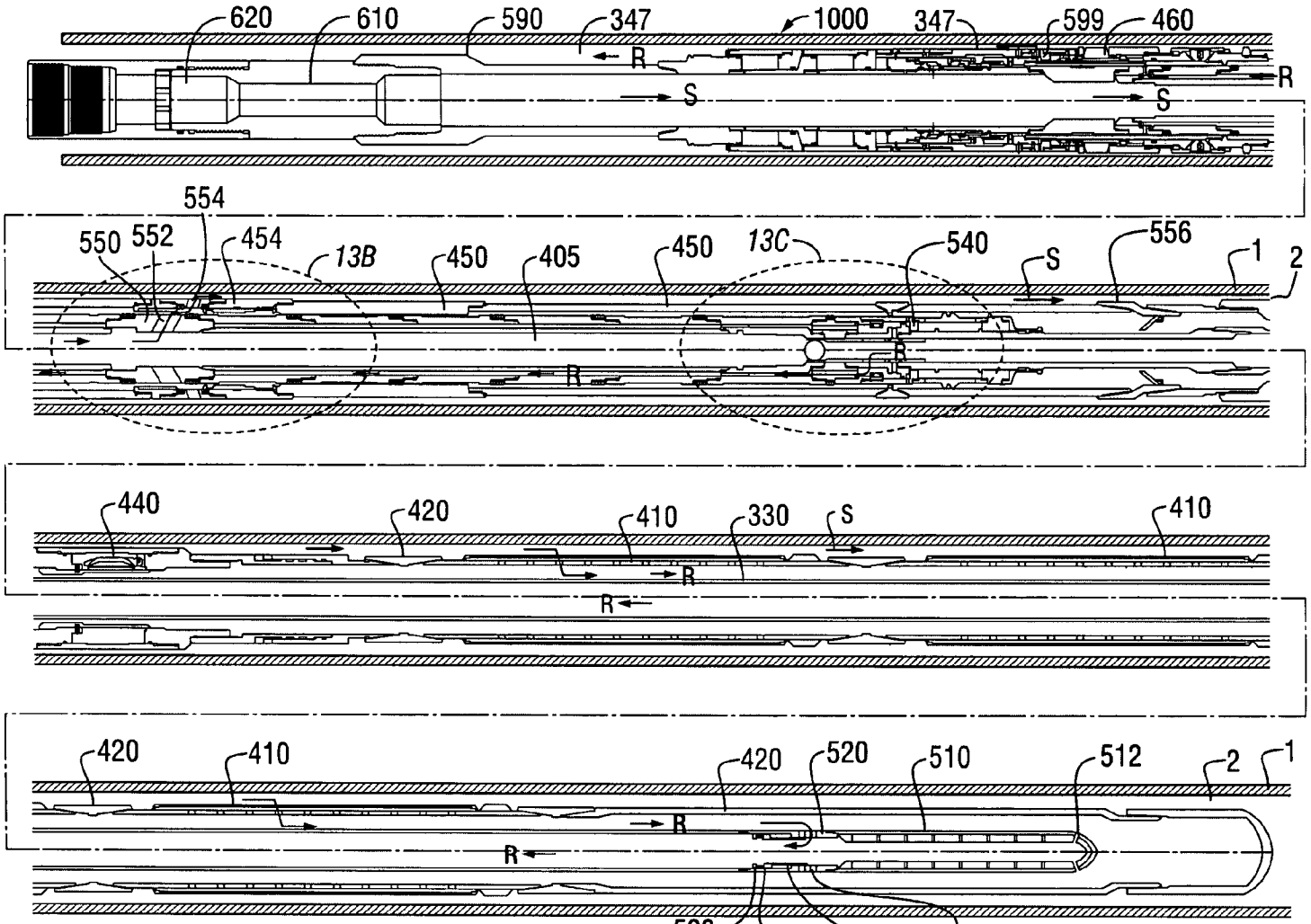
FIG. 13A shows a well completion tool assembly according to the present disclosure during gravel packing, with FIGS. 13B and 13C providing detailed views of sections of FIG. 13A.
Figure 13B:
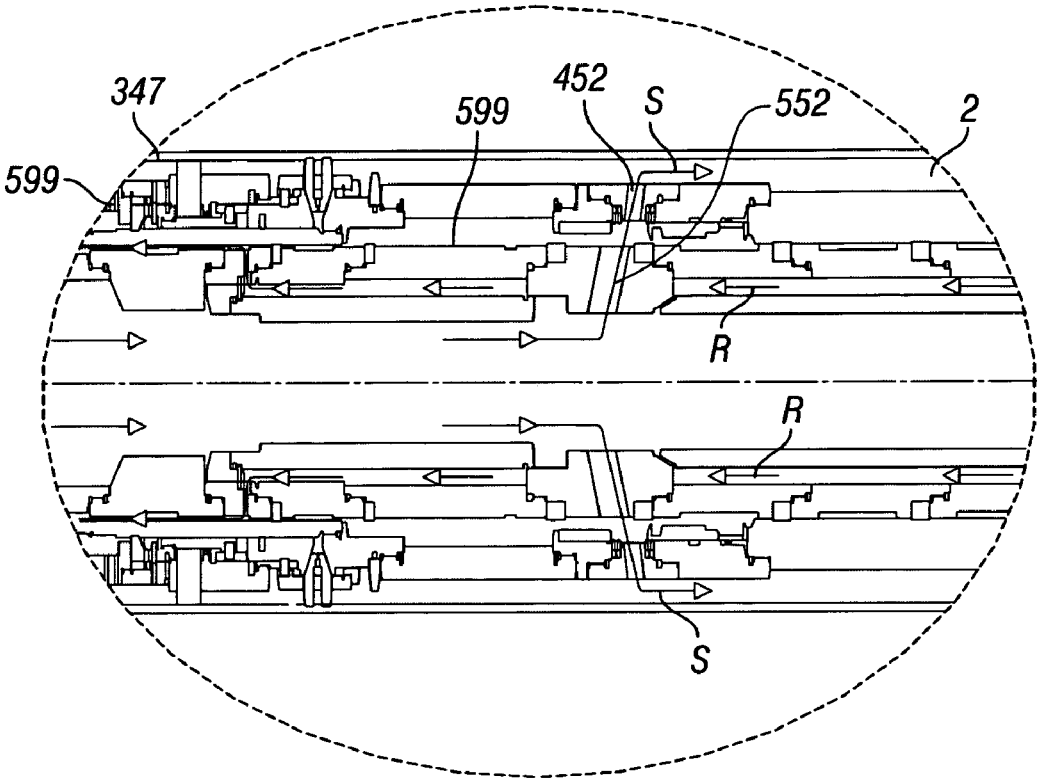
Figure 13C:
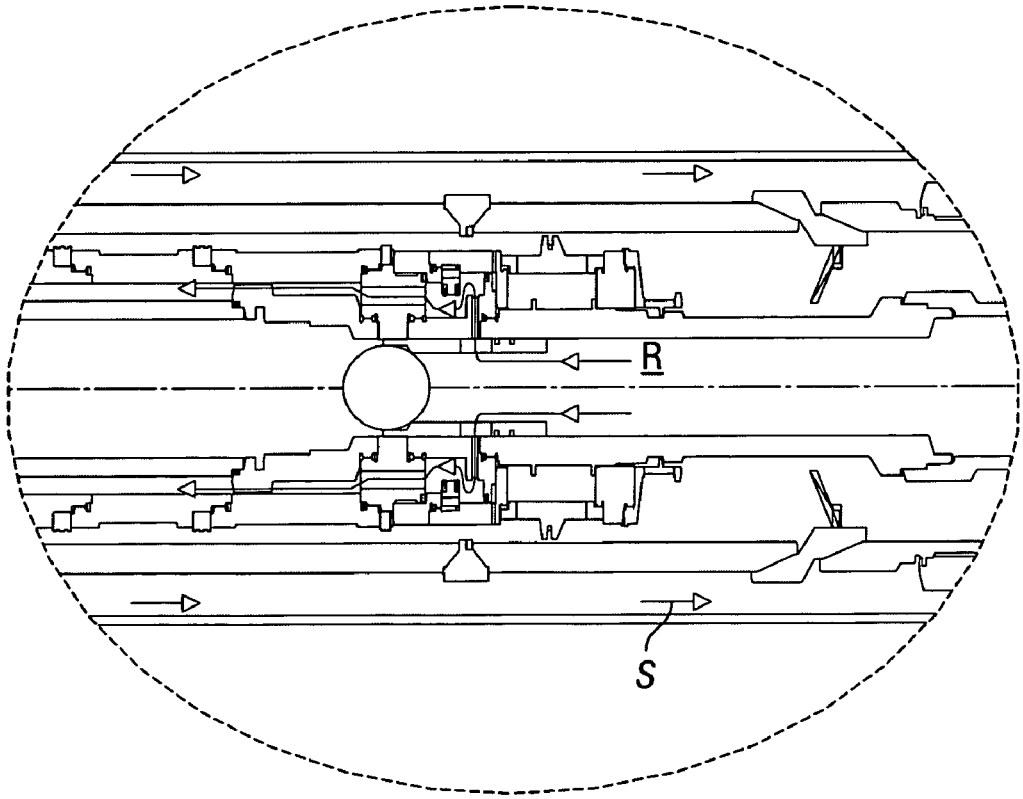

Gravel Packing. As shown in FIGS. 13A-C, the service tool assembly 500 is once again removably coupled to the gravel packing assembly 400 by the setting tool 590. In this position, the apertures 552 in the crossover tool 550 again substantially align with the now-open gravel packing apertures 452. Thus, the slurry S used for gravel packing is pumped in through annular channel 405, and is diverted by the first plugging device 322 through the crossover tool apertures 552 and gravel packing apertures 452 in the sliding sleeve 450, and out into the annulus or second annular space 2 between the completion tool assembly 1000 and the wellbore 1, where the slurry S deposits sand in the production screens 410. The differential valve 520 opens, because the pressure of the returns R external the valve 520 is greater than the pressure within the valve 520, due to the pumping downhole. The pressure generates an upward force on the sleeve 524 to overcome the biasing force of the spring 526. Ports 522 thereby open. Sand-free fluid (returns "R") pass through the production screens 420, through the ports 522 in the differential valve 520 and into the lower portion of the interior channel 405, pass through the annular bypass port 562, internal conduit 549, and exterior port 599, and into the annular space 347 between the completion tool 1000 and the wellbore 1 above the packer 460.

Stimulating. Once gravel packing is complete, the filter cake must be removed before oil or gas can be extracted from the surrounding formation. According to the present disclosure, the above-described completion tool assembly 1000 may also simply and easily perform well stimulation to remove the filter cake while remaining in the well without removing the gravel pack assembly. That is, the gravel packing operation and the stimulating of the formation advantageously may be performed in a single trip, thus significantly reducing the cost and time associated with performing these two operations.

Figure 14A:
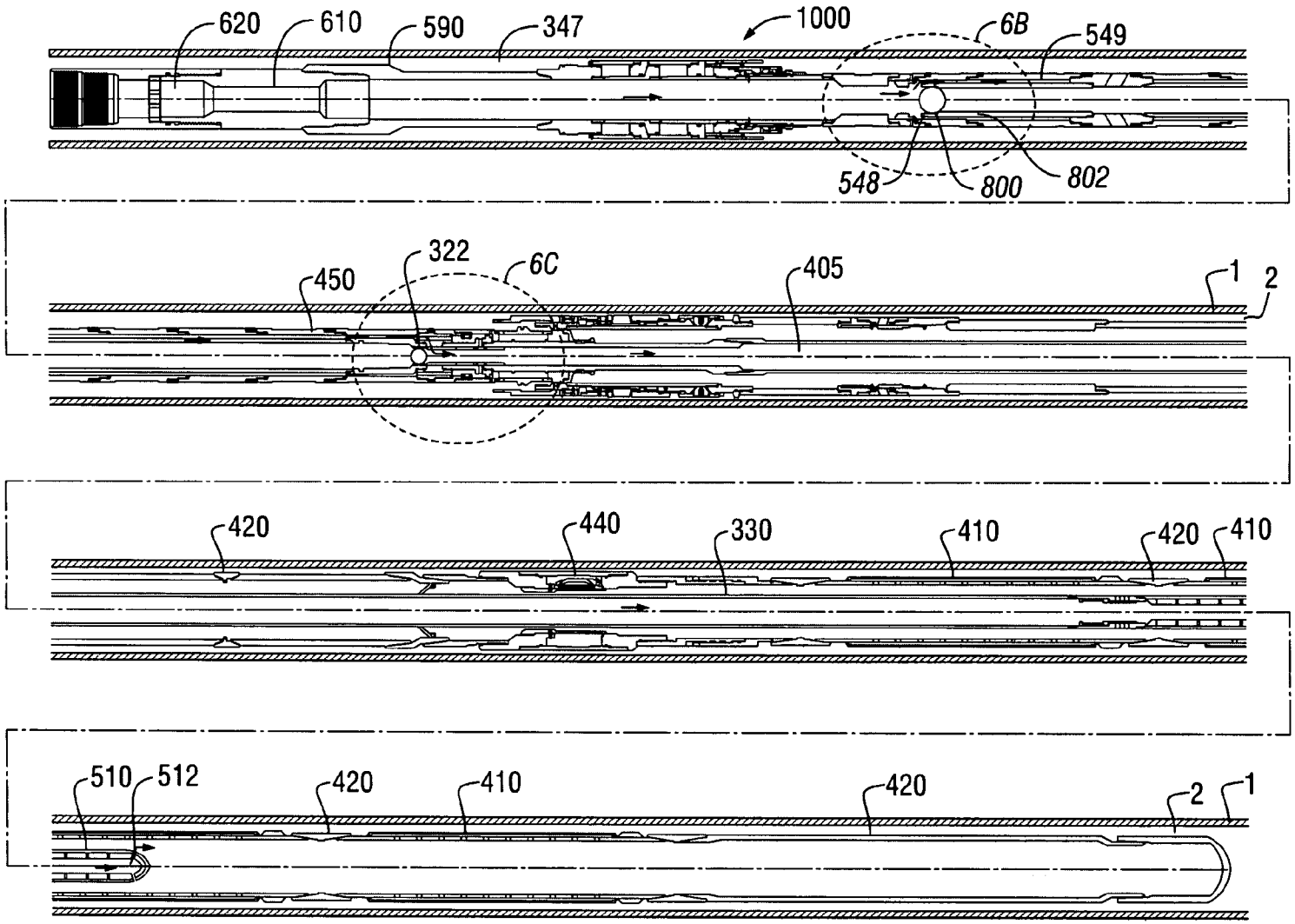
FIG. 14A shows a well completion tool assembly according to the present disclosure during stimulation of the well, with FIGS. 14B and 14C providing detailed views of sections of FIG. 14A.
Figure 14B:
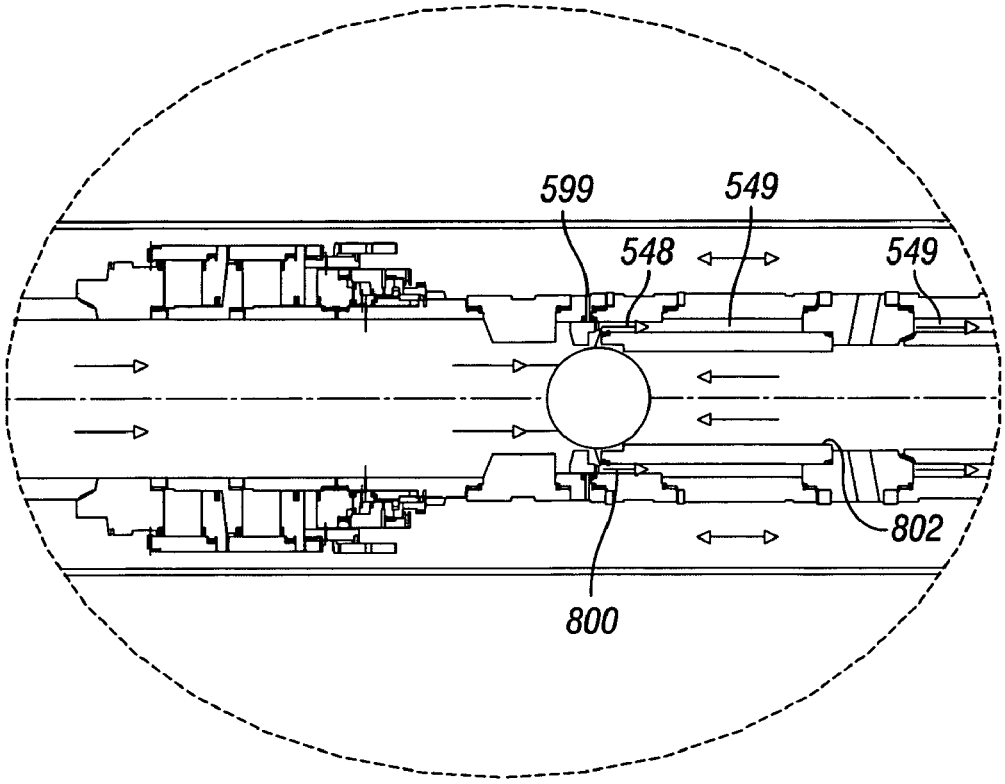
Figure 14C:
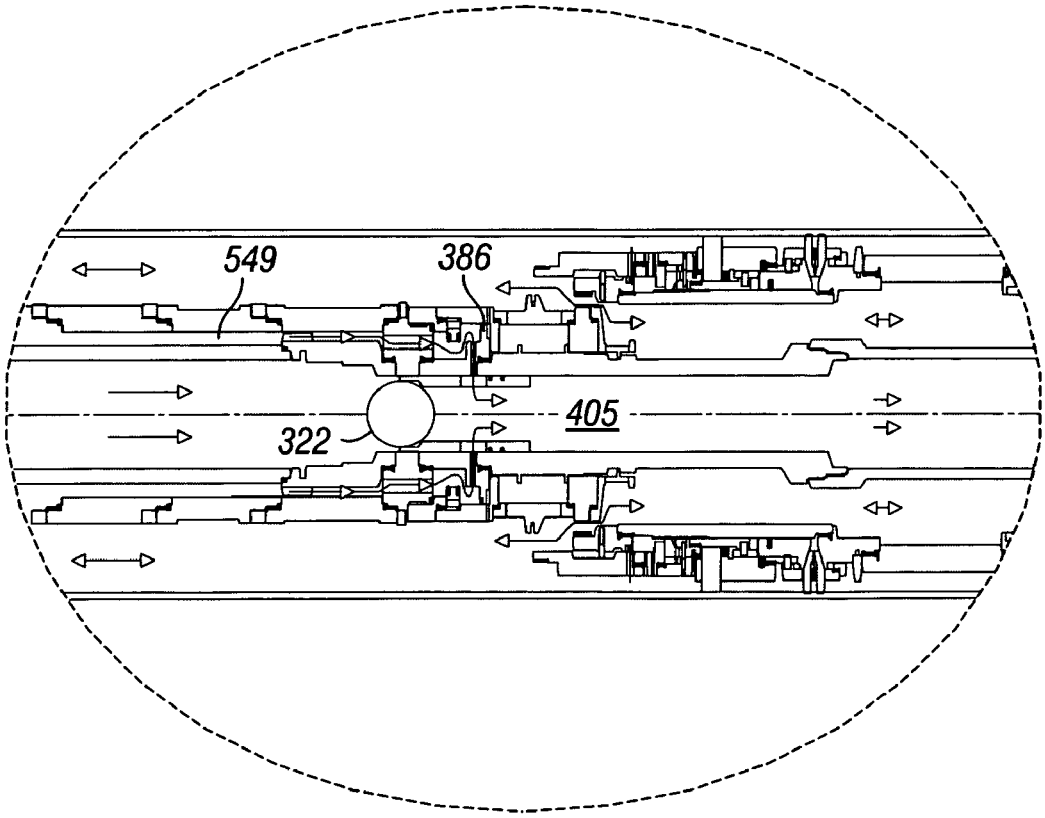

As shown in FIGS. 14A-C, a second plugging device 800 is inserted into the interior channel 405 of the service tool assembly 500 to once again divert fluid flow. The second plugging device 800 can be made of any suitable material, i.e., steel, and can be inserted into the service tool assembly 500 in the same manner as described above for the first plugging device 322. The second plugging device 800, however, is of a diameter and configuration such that the second plugging device 800 is adapted to form a seal in a section of the interior channel 405 of the service tool assembly 500 that is above or proximal of the crossover tool apertures 552, thereby isolating the crossover tool apertures 552 with plugging devices 322 and 800 both above and below. It is noted that in some embodiments, a third ball selectively may be dropped from surface to seat in the check valve, thereby preventing the acid flow back.

The interior conduit 549 of the crossover tool 550 also extends between the annular bypass port 562 and an interior port 548 into the interior channel 405 at a location proximal of the crossover tool aperture 552. This interior port 549 is opened by a sleeve 802, which is shifted downward by the second plugging device 800. This sleeve 802 opens the interior port 549. Fluid pumped into the interior channel 405 above the second plugging device 800 is now diverted through the interior port 548, the interior conduit 549 within the crossover tool 550, the annular bypass port 562, and back into the interior channel 405 at a point below the first plugging device 322. Thus, fluid will once again flow into the interior channel 405 at a point below or distal of the first plugging device 322, and the completion tool assembly 1000 can now be used to stimulate the well.

Figure 15:
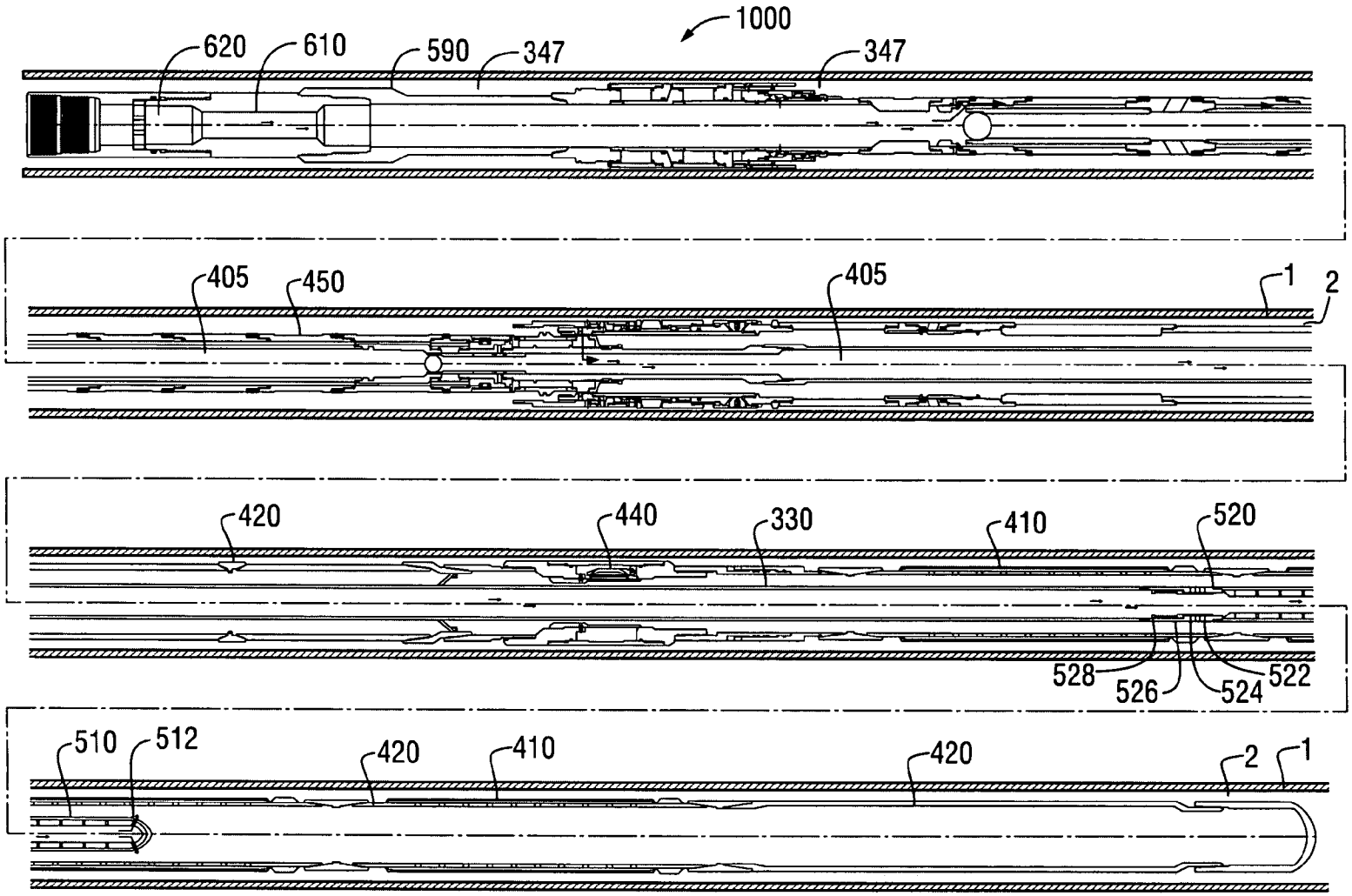
FIG. 15 shows a well completion tool assembly according to the present disclosure during stimulation a pressure pulsating rotating jetting tool.

FIG. 15 shows the completion tool assembly while stimulating. Stimulating fluid such as acids or solvents are pumped into the distal end of the interior chamber 405 through the fluid path described above and shown in FIGS. 14A-C. Fluid exiting into the interior channel 405 at a point below the first plugging device 322 operates to rotate the pressure pulsating rotating jetting tool 510 via the turbines (not shown). The fluid then exits the ports 512 on the mole 513 of the pressure pulsating rotating jetting tool 510, thus generating pressure pulsating jets of stimulation fluid. As the service tool assembly 500 is pulled upwardly, the fluid exits ports 512 and passes through the production screens 410 of the gravel packing assembly 400 thereby stimulating the formation. The stimulation fluid is diverted through the production screens 410. In this embodiment, slick joints are not required to seal off flow above and below each of the production screens 410, and seal subs are not required. This simplifies the construction and operation of the completion tool 1000 considerably. For instance, the calculation of the slick joint geometry to mate with the placement of the seal joints is not required. Rather, the pressure pulsating rotating tool 510 is pulled upwardly, continuously stimulating the production screens 410 as the tool 510 pass nearby. Thus, the stimulation of the wellbore may be performed continuously, as opposed to sealing off each section (via the slick joints/seal sub combination) and stimulating section by section. Further, the mechanical vibration of the pressure pulsating rotating jetting tool 510 increases the stimulation effectiveness and efficiency of the apparatus.

The stimulation fluid reacts with the filter cake on the surrounding wellbore 1 to dissolve the filter cake. According to the present embodiment, the filter cake in the proximity of each production screen 410 is dissolved as the pressure pulsating rotating jetting tool 510 passes proximate each screen 410, beginning with the lowermost screen 410. This is done both to ensure that there is adequate pressure to force the stimulation fluid out into the filter cake, and also to ensure that the filter cake is dissolved in a controlled fashion to prevent leakage before production is ready to begin. The service tool assembly 500 is simply retracted from within the gravel packing assembly 400 to move from one screen 410 to the next.

Figure 16:
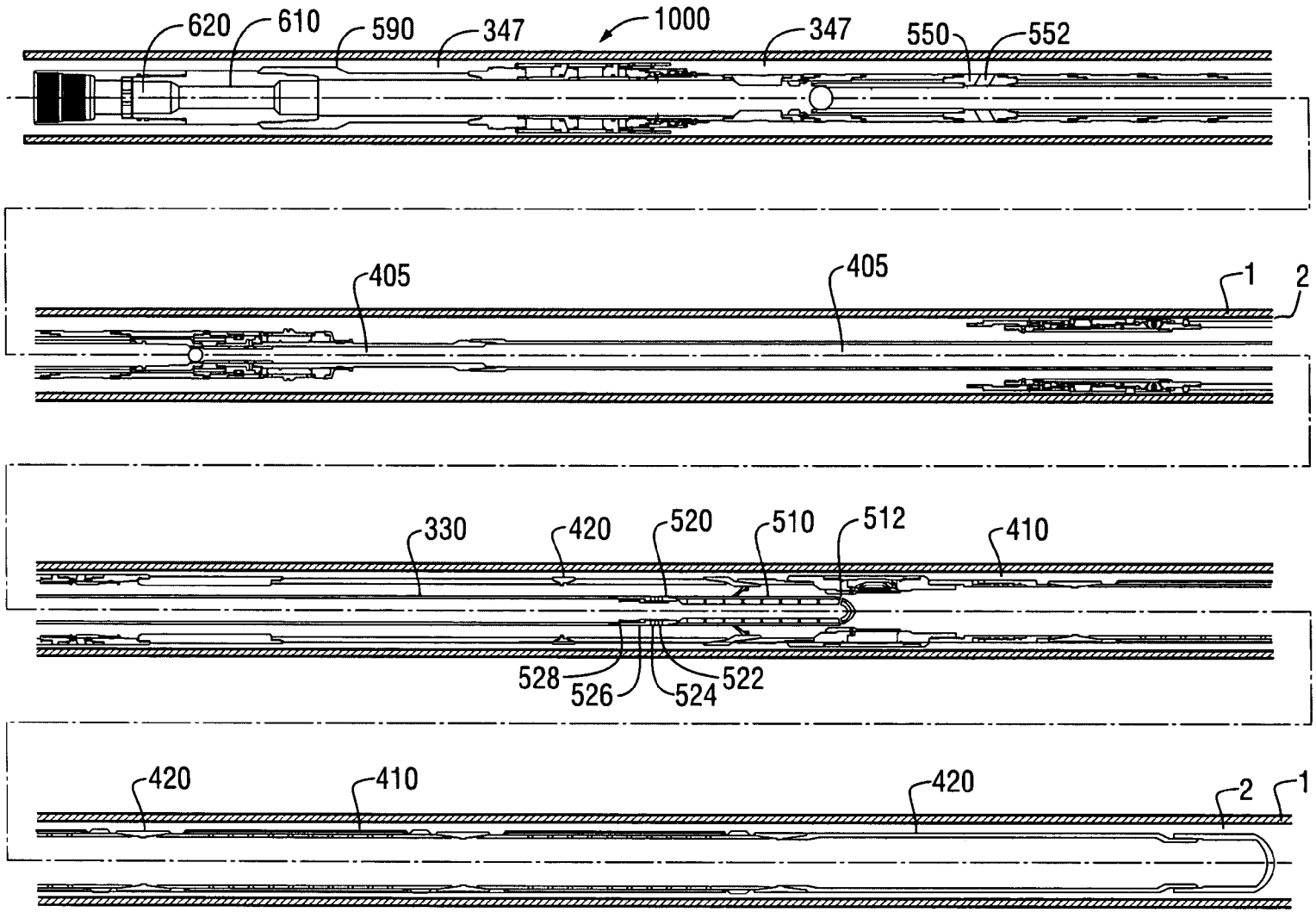
FIG. 16 shows a well completion tool assembly 1000 according to the present disclosure during pulling out of hole (POOH).

POOH. Subsequently, the service tool assembly is removed from the wellbore 1, as shown in FIGS. 15 and 16.

As the service tool assembly 500 is removed, the optional safety valve 440 such as a flapper valve closes to prevent loss of oil or gas before the production tubing is in place and production is ready to begin.

Production. When production begins, the production screens filter out sand and other elements of the formation from the oil or gas.

Figure 17A:
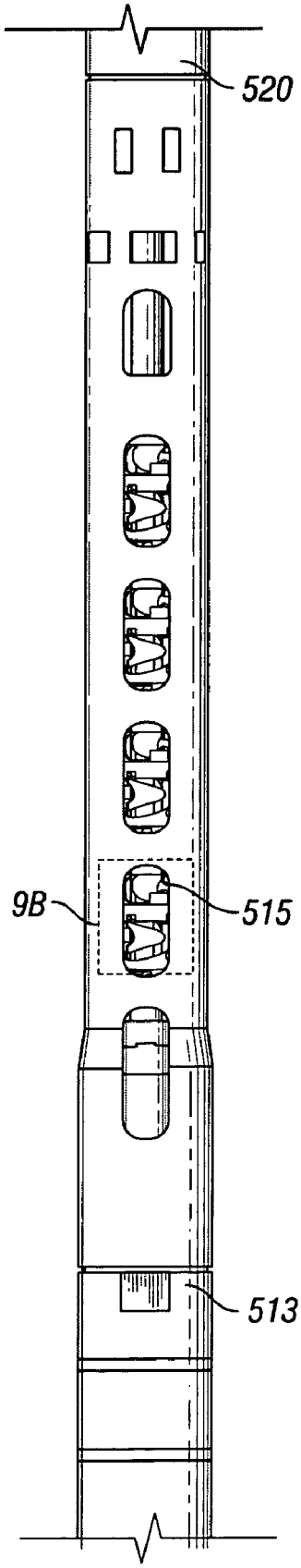
FIGS. 17A & B show a fluid drive mechanism for one embodiment of the present invention.
Figure 17B:
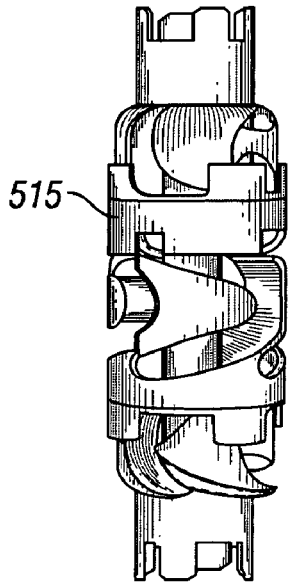

Finally, FIGS. 17A & B show the turbine 515 as the drive mechanism of one embodiment of the present invention described above.

The disclosed completion tool advantageously eliminates the need for the use of the slick joints and the seal subs. In this way, stimulation may be accomplished selectively without the need for slick joints and seal subs. As such, no calculations for spacing out the seal subs with respect to the slick joints is required. Thus, with the disclosed completion tool 1000, the gravel packing and improved stimulation utilizing pressure pulsating rotating jets may be accomplished in a single trip.

The following table lists the description and the references designators as may be utilized herein and in the attached drawings.

| Reference Designator | Component |
|---|---|
| 1 | Wellbore |
| 2 | Annulus between tool and wellbore |
| 322 | First Plugging Device |
| 347 | First Annular Space (above packer) |
| 400 | Gravel Packing Assembly |
| 405 | Interior Channel (e.g. Passageway or Bore) of tool/assembly |
| 410 | Production Screen |
| 420 | Connections |
| 430 | Bull Plug |
| 440 | Safety Valve |
| 450 | Sliding Sleeve |
| 452 | Aperture on Sliding Sleeve for gravel packing |
| 454 | Temporary closing sleeve |
| 456 | Centralizer Sub |
| 458 | Inverted Packer cup |
| 460 | Packer |
| 490 | Temporary Interference Collar on Gravel Packer |
| 500 | Stimulation or Service Tool Assembly |
| 501 | Interference Member |
| 510 | Pressure Pulsating Rotating Jetting Tool (e.g. Roto-Jet) |
| 512 | Ports in jetting tool |
| 513 | Mole |
| 515 | Turbine |
| 520 | Differential Valve |
| 522 | Ports in valve 520 |
| 524 | Sleeve in valve 520 |
| 526 | Spring |
| 528 | Flange |
| 530 | Washpipe |
| 540 | Circulation Valve |
| 542 | Ball seat |
| 548 | (upper) Interior Port of Crossover Tool 550 |

-continued

| Reference Designator | Component |
|---|---|
| 549 | Conduits in crossover 550 between annular bypass 562 and either port 548 or external port 599 |
| 550 | Crossover Tool |
| 552 | Crossover Tool Aperture |
| 560 | Circulating Valve |
| 562 | Annular bypass port |
| 564 | Temporary closing sleeve |
| 566 | Aperture in closing sleeve |
| 588 | Isolation Valve of Service Tool |
| 590 | Setting Tool |
| 599 | External port at or above apertures 552 |
| 610 | Workstring |
| 620 | Check Valve |
| 800 | Second Plugging Device |
| 802 | Sleeve |
| 1000 | Completion Tool Assembly |

What is claimed is:

1. A method for completing a well in a single trip, comprising the steps of:

providing a completion tool assembly having a service tool assembly functionally associated within a gravel packing assembly, the service tool assembly including a stimulation tool assembly having a rotating jetting tool, an internal channel being formed within the completion tool assembly;

inserting the completion tool assembly into a wellbore;

removably coupling the service tool assembly and the gravel packing assembly;

plugging at a first location, whereby fluid is blocked from flowing downhole through the interior channel;

diverting fluid blocked by the plugging at the first location through a first fluid flow path to an exterior of the completion tool assembly;

gravel packing by circulating a slurry through the completion tool assembly;

plugging at a second location to block fluid from flowing downhole through the interior channel;

diverting fluid blocked by the plugging at the second location through a second flow path that reenters the interior channel at a location below the first and second plugging locations; and stimulating by circulating a stimulating fluid through the stimulation tool assembly of the well completion assembly.

2. The method of claim 1 in which the step of stimulating by circulating a stimulating fluid further comprises circulating the stimulating fluid through the rotating jetting tool of the stimulation tool assembly of the well completion assembly.

3. The method of claim 2 in which the step of gravel packing further comprises opening a differential valve to allow fluid communication from the first flow path to return to the interior channel.

4. The method of claim 3 in which the step of opening the differential valve further comprises selectively sliding a sleeve relative to a housing on the differential valve thereby allowing fluid communication through at least one port in the housing, the sleeve overcoming a biasing force of a biasing means.

5. The method of claim 4 in which the biasing means is a spring abutting a flange, the spring being functionally associated with the sleeve.

6. The method according to claim 2, in which the plugging at a first location further comprises inserting a first plugging device into an interior channel within the service tool assembly to substantially block fluid from flowing through the interior channel past the first plugging device;

the circulating a slurry further comprises gravel packing the wellbore with the completion tool assembly;

the plugging at a second location further comprises inserting a second plugging device into the interior channel of the service tool assembly to substantially block fluid from flowing through the interior channel below the second plugging device; and the step of stimulation further comprises stimulating the well with the well completion assembly by the stimulation fluid passing through port of the rotating jetting tool and contacting a filter cake on the wellbore.

7. The method of claim 2, in which the step of stimulating further comprises passing the stimulation fluid through the rotating jetting tool, thorough a production screen and the gravel pack, to contact a filter cake.

8. The method of claim 7 in which step of passing the stimulation fluid includes passing the stimulation fluid through a plurality of ports in a rotating mole to produce jets of stimulation fluid.

9. The method of claim 8 in which the step of rotating further comprises rotating the mole by a drive mechanism.

10. The method of claim 9 in which the step of rotating performed by the drive mechanism is performed by a turbine adapted rotate the mole as fluid passes through the turbine.

11. The method according to claim 2, wherein the gravel packing assembly further includes a gravel packing aperture therein, and wherein the service tool assembly further includes a crossover tool comprising a crossover tool aperture therein.

12. The method of claim 11, wherein fluid flowing through the first fluid flow path flows through the crossover tool aperture and the gravel packing aperture.

13. The method of claim 12, wherein the first inserting step further comprises inserting the plugging device within the interior channel at a location below the cross-over tool aperture and above an annular bypass port.

14. The method of claim 13, wherein the crossover tool further comprises an internal conduit extending between an annular bypass port into the interior channel located distal of the crossover tool aperture, and an exterior port to a first annular space exterior of the service tool assembly located proximal of the crossover tool aperture.

15. The method of claim 14, wherein the internal conduit further extends between the annular bypass port and an internal port to an interior of the internal conduit located proximal of the crossover tool aperture.

16. The method of claim 12, wherein the second inserting step further comprises inserting the second plugging device within the interior channel at a location proximal of the crossover tool aperture and distal of the internal port.

17. The method of claim 16, further comprising the steps of, prior to the gravel packing step: opening the annular bypass port; setting the gravel packer; closing the annular bypass port; testing the gravel packer; and opening the annular bypass port.

18. The method of claim 16, in which the stimulation step further comprising the step of pumping a stimulation fluid into the interior channel and through the second fluid flow path, wherein the fluid flows through the internal conduit, the interior port, the annular bypass port, and into the interior channel of the service tool assembly at the location distal of the first and second plugging devices, and through the rotating jetting tool.

19. A well completion tool assembly for gravel packing and stimulating a well comprising:

a gravel packing assembly including a gravel packer; and a service tool assembly slidably disposed within an interior channel of the gravel packing assembly and capable of being removably coupled thereto, the service tool assembly including a crossover tool having a crossover tool aperture therein, an interior conduit between an annular bypass port into the interior channel located distal of the crossover tool aperture and an exterior port to an exterior of the service tool assembly located proximal of the crossover tool aperture, and an annular bypass closing mechanism for selectively opening and closing the annular bypass port, in which the service tool includes a rotating jetting tool connectable to a washpipe by a differential valve.

20. The well completion tool assembly of claim 19, wherein the gravel packing assembly has a gravel packing aperture therein in fluid communication with the crossover tool aperture when the gravel packing assembly is removable coupled to the service tool assembly, and a temporary closing sleeve for selectively opening and closing the gravel packing assembly aperture.

21. The well completion tool assembly of claim 20, further comprising a first plugging device capable of being received within the interior channel of the service tool assembly at a location distal of the crossover tool aperture and proximal of the annular bypass port, wherein when inserted, the first plugging device substantially blocks fluid from flowing through the interior channel past the first plugging device.

22. The well completion tool assembly of claim 21, wherein the internal conduit further extents between the annular bypass port and an interior port into the interior channel located proximal of the cross-over tool aperture.

23. The well completion tool assembly of claim 22, further comprising a second plugging device capable of being received within the interior channel of the service tool assembly at a location proximal of the crossover tool aperture and distal of the interior port, wherein when inserted, the second plugging device substantially blocks fluid from flowing through the interior channel past the second plugging device.

24. A method for completing a wellbore comprising the steps of:

inserting into the wellbore a completion tool assembly comprising a gravel packing assembly comprising a gravel packer, and a service tool assembly slidably positioned substantially within an interior channel of the gravel packing assembly and comprising an interior channel therein;

removably coupling the service tool assembly to the gravel packing assembly; setting the gravel packer;

obstructing the interior channel with a first obstruction device;

opening a first fluid flow path between the interior channel at a location proximal of the first obstruction device and an exterior of the well completion assembly at a location below of the gravel packer;

gravel packing the wellbore with the completion tool assembly by pumping a slurry into an upper end of the interior channel and through the first fluid flow path;

obstructing the first fluid flow path with a second obstruction device to prevent fluid flowing into the upper end of the interior channel from flowing through the first fluid flow path;

opening a second fluid flow path between the interior channel at a location proximal of the second obstruction device and the interior channel at a location below the first obstruction device, and stimulating the well with the completion tool assembly by pumping a stimulating fluid into the proximal end of the interior channel, through the second fluid flow path, and through a through a pressure pulsating rotating jetting tool to produce a pulsating jet of stimulating fluid.

25. The method of claim 24 further comprising when the second fluid flow path is opened to the work string, an external port is closed.

* * * * *

UNITED STATES PATENT AND TRADEMARK OFFICE

CERTIFICATE OF CORRECTION

PATENT NO. : 7,331,388 B2
APPLICATION NO. : 11/348275
DATED : February 19, 2007
INVENTOR(S) : Alvaro Jose Vilela et al.

It is certified that error appears in the above-identified patent and that said Letters Patent is hereby corrected as shown below:

In Column 20, line 20, change "thorough" to --through--.

In Column 21, line 38, change "extents" to --extends--.

In Column 22, line 35, delete the second occurrence of "through a".

Signed and Sealed this

Twenty-ninth Day of September, 2009

David J. Kappos

David J. Kappos
*Director of the United States Patent and Trademark Office*